US008696081B2

(12) United States Patent
Hibino

(10) Patent No.: US 8,696,081 B2
(45) Date of Patent: Apr. 15, 2014

(54) DROPLET EJECTING DEVICE CAPABLE OF MAINTAINING RECORDING QUALITY WHILE SUPPRESSING DETERIORATION OF ACTUATOR

(75) Inventor: Tomoko Hibino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 421 days.

(21) Appl. No.: 13/032,391

(22) Filed: Feb. 22, 2011

(65) Prior Publication Data

US 2011/0205273 A1 Aug. 25, 2011

(30) Foreign Application Priority Data

Feb. 19, 2010 (JP) ..... 2010-034995

(51) Int. Cl.
*B41J 29/38* (2006.01)

(52) U.S. Cl.
USPC ..... 347/10; 347/68; 347/70; 347/71; 347/74; 347/75

(58) Field of Classification Search
USPC ..... 347/10, 11, 29, 68–78
See application file for complete search history.

(56) References Cited

U.S. PATENT DOCUMENTS

| | | | | |
|---|---|---|---|---|
| 6,474,784 | B1 | 11/2002 | Fujii et al. | |
| 2001/0007460 | A1 | 7/2001 | Fujii et al. | |
| 2004/0041885 | A1 * | 3/2004 | Hirota | 347/72 |
| 2006/0290749 | A1 * | 12/2006 | Satake et al. | 347/70 |
| 2007/0176978 | A1 | 8/2007 | Sugahara | |
| 2007/0188544 | A1 * | 8/2007 | Morikoshi | 347/29 |
| 2008/0024535 | A1 * | 1/2008 | Ito | 347/11 |
| 2008/0218549 | A1 | 9/2008 | Iriguchi | |
| 2009/0244204 | A1 | 10/2009 | Ono et al. | |

FOREIGN PATENT DOCUMENTS

| | | | |
|---|---|---|---|
| EP | 1813427 | A2 | 8/2007 |
| JP | 2000-168070 | A | 6/2000 |
| JP | 2001-179964 | A | 7/2001 |
| JP | 2006-166529 | A | 6/2006 |
| JP | 2006-167506 | A | 6/2006 |

(Continued)

OTHER PUBLICATIONS

European Patent Office, Extended European Search Report for European Patent Application No. 11154554.7 (counterpart to above-captioned patent application), dated Apr. 5, 2011.

(Continued)

*Primary Examiner* — Manish S Shah
*Assistant Examiner* — Yaovi Ameh
(74) *Attorney, Agent, or Firm* — Baker Botts L.L.P.

(57) ABSTRACT

First and second piezoelectric layers are stacked from a side closer to an opening of a liquid channel formed in a channel member in this order, and are sandwiched between electrodes with respect to a stacking direction. A driving-signal generating section generates an ejection driving signal for ejecting droplets from an ejection port and a non-ejection driving signal for vibrating a meniscus formed in the ejection port without ejecting droplets from the ejection port. A voltage applying section applies, based on image data, a voltage corresponding to the ejection driving signal to one of the first and second piezoelectric layers, and applies a voltage corresponding to the non-ejection driving signal to another one of the first and second piezoelectric layers during a period in which the voltage corresponding to the ejection driving signal is not applied to the one of the first and second piezoelectric layers.

17 Claims, 10 Drawing Sheets

(56) References Cited

FOREIGN PATENT DOCUMENTS

| | | | |
|---|---|---|---|
| JP | 2007-203515 | A | 8/2007 |
| JP | 2008-006685 | A | 1/2008 |
| JP | 2008-221482 | A | 9/2008 |
| JP | 2009-083280 | A | 4/2009 |
| JP | 2009-241548 | A | 10/2009 |

OTHER PUBLICATIONS

Japan Patent Office, Office Action for Japanese Patent Application No. 2010-034995 (counterpart to above-captioned patent application), mailed Dec. 6, 2011.

* cited by examiner

DROPLET EJECTING DEVICE CAPABLE OF MAINTAINING RECORDING QUALITY WHILE SUPPRESSING DETERIORATION OF ACTUATOR

CROSS REFERENCE TO RELATED APPLICATIONS

This application claims priority from Japanese Patent Application No. 2010-034995 filed Feb. 19, 2010. The entire content of the priority application is incorporated herein by reference.

TECHNICAL FIELD

The invention relates to a droplet ejecting device that ejects droplets such as ink from ejection ports.

BACKGROUND

In an inkjet-type printer which is one example of a droplet ejecting device, such a technology is known that a piezoelectric actuator is used to apply, to ink within a channel having an ejection port at its distal end, energy of a degree that does not eject an ink droplet from the ejection port to vibrate a meniscus formed in the ejection port (non-ejection flushing), thereby maintaining a condition of the meniscus. Especially when ink with high viscosity and quick drying characteristics is used, an increase in viscosity of ink and hardening of ink tend to occur near the ejection port. However, by performing non-ejection flushing, it is possible to maintain conditions of menisci and to maintain recording quality.

SUMMARY

The invention provides a liquid ejecting device including a channel member, an actuator, a driving-signal generating section, and a voltage applying section. The channel member is formed with a liquid channel having an ejection port for ejecting droplets. The channel member has a surface formed with an opening through which a part of the liquid channel is exposed. The actuator includes a layered body disposed on the surface of the channel member so as to confront the opening for applying energy to liquid in the opening. The layered body includes a first piezoelectric layer and a second piezoelectric layer stacked from a side closer to the opening in this order. The first and second piezoelectric layers are sandwiched between electrodes with respect to a stacking direction. The driving-signal generating section is configured to generate driving signals for driving the actuator. The driving-signal generating section is configured to generate an ejection driving signal for ejecting droplets from the ejection port and a non-ejection driving signal for vibrating a meniscus formed in the ejection port without ejecting droplets from the ejection port. The voltage applying section is configured, based on image data of an image to be recorded on a recording medium, to apply a voltage corresponding to the ejection driving signal to one of the first and second piezoelectric layers, and to apply a voltage corresponding to the non-ejection driving signal to another one of the first and second piezoelectric layers during a period in which the voltage corresponding to the ejection driving signal is not applied to the one of the first and second piezoelectric layers.

BRIEF DESCRIPTION OF THE DRAWINGS

Embodiments in accordance with the invention will be described in detail with reference to the following figures wherein.

DETAILED DESCRIPTION

Figure 1:
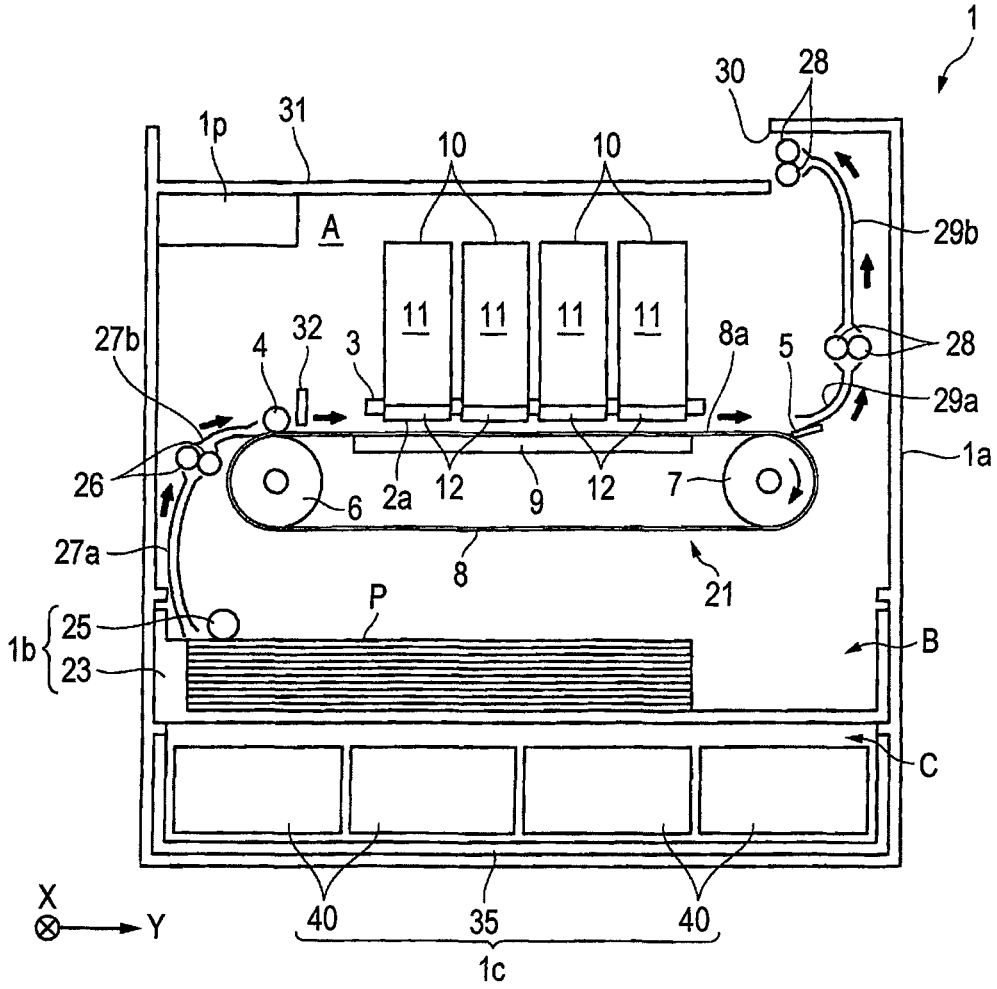
FIG. 1 is a schematic side view showing the internal structure of an inkjet-type printer embodying a droplet ejecting device according to an embodiment of the invention.

A droplet ejecting device according to some aspects of the invention will be described while referring to the accompanying drawings. In the following description, the expressions "upper" and "lower" are used to define the various parts when the droplet ejecting device is disposed in an orientation in which it is intended to be used.

First, the overall configuration of an inkjet-type printer 1 embodying a droplet ejecting device according to an embodiment will be described while referring to FIG. 1.

The printer 1 has a casing 1*a* having a rectangular parallelepiped shape. A paper discharging section 31 is provided on a top plate of the casing 1*a*. The internal space of the casing 1*a* is divided into spaces A, B, and C in this order from the top. The spaces A and B are spaces in which a paper conveying path leading to the paper discharging section 31 is formed. In the space A, conveyance of paper P and image formation onto paper P are performed. In the space B, operations for feeding paper are performed. In the space C, ink cartridges 40 as ink supply sources are accommodated.

Four inkjet heads 10, a conveying unit 21 that conveys paper P, a maintenance mechanism 400*a* (see FIG. 8) provided in association with the conveying unit 21, a guide unit 300*a* (see FIG. 8) that guides paper P, and the like are arranged in the space A. A controller 1*p* is disposed at the top part of the space A. The controller 1*p* controls operations of each section of the printer 1 including these mechanisms and manages the overall operations of the printer 1.

The controller 1*p* controls a preparatory operation for image formation, operations of feeding, conveying, and discharging paper P, an ink ejecting operation in synchronization with conveyance of paper P, operations of recovering and maintaining ejection performance (maintenance operation), and the like, so that an image is formed on paper P based on image data supplied from outside. The hardware configuration of the controller 1*p* and functions of the controller 1*p* implemented by programs will be described later.

Each head 10 is a line head having substantially a rectangular parallelepiped shape elongated in a main scanning direction X. The four heads 10 are arranged in a sub-scanning direction Y with a predetermined pitch, and are supported by the casing 1*a* via a head frame 3. Each head 10 includes a channel unit 12, eight actuator units 17 (see FIG. 2), and a reservoir unit 11. During image formation, ink droplets of magenta, cyan, yellow, and black colors are ejected from the lower surface (ejection surface 2*a*) of a corresponding one of the four heads 10, respectively. More specific configurations of the heads 10 will be described later in greater detail.

As shown in FIG. 1, the conveying unit 21 includes belt rollers 6 and 7, an endless-type conveying belt 8 looped around the both rollers 6 and 7, a nip roller 4 and a separation plate 5 arranged outside the conveying belt 8, a platen 9 disposed inside the conveying belt 8, and the like.

The belt roller 7 is a drive roller, and rotates by driving of a conveying motor (not shown) in the clockwise direction in FIG. 1. Rotation of the belt roller 7 causes the conveying belt 8 to move in directions shown by the thick arrows in FIG. 1. The belt roller 6 is a follow roller, and rotates in the clockwise direction in FIG. 1 by following the movement of the conveying belt 8. The nip roller 4 is disposed to confront the belt roller 6, and presses paper P supplied from an upstream-side guide section (described later) against an outer peripheral surface 8*a* of the conveying belt 8. The separation plate 5 is disposed to confront the belt roller 7, and separates paper P from the outer peripheral surface 8*a* and guides the same to a downstream-side guide section (described later). The platen 9 is disposed to confront the four heads 10, and supports an upper loop of the conveying belt 8 from the inside. With this arrangement, a predetermined gap suitable for image formation is formed between the outer peripheral surface 8*a* and the ejection surfaces 2*a* of the heads 10.

The maintenance mechanism 400*a* (see FIG. 8) includes an ink forceful supplying pump, an ink discharging pump, a waste ink reservoir, a wiper, a wiper moving mechanism, a cap, a cap moving mechanism (these components are not shown), and the like. The maintenance mechanism 400*a* performs maintenance operations of preliminary ejection, purging, wiping, capping, and the like.

The guide unit 300*a* (see FIG. 8) includes the upstream-side guide section and the downstream-side guide section which are arranged with the conveying unit 21 interposed therebetween. The upstream-side guide section includes two guides 27*a* and 27*b* and a pair of feed rollers 26. The upstream-side guide section connects a paper supplying unit 1*b* (described later) and the conveying unit 21. The downstream-side guide section includes two guides 29*a* and 29*b* and two pairs of feed rollers 28. The downstream-side guide section connects the conveying unit 21 and the paper discharging section 31.

In the space B, the paper supplying unit 1*b* is disposed so as to be detachable from the casing 1*a*. The paper supplying unit 1*b* includes a paper supplying tray 23 and a paper supplying roller 25. The paper supplying tray 23 is a box which is opened upward, and can accommodate paper P in a plurality of sizes. The paper supplying roller 25 picks up paper P at the topmost position in the paper supplying tray 23 and supplies the same to the upstream-side guide section.

As described above, in the spaces A and B, a paper conveying path is formed from the paper supplying unit 1*b* via the conveying unit 21 to the paper discharging section 31. Based on a print command, the controller 1*p* drives a paper supplying motor (not shown) for the paper supplying roller 25, a feed motor (not shown) for feed rollers of each guide section, the conveying motor, and the like. A sheet of paper P sent out of the paper supplying tray 23 is supplied to the conveying unit 21 by the pair of feed rollers 26. When the paper P passes positions directly below each head 10 in the sub-scanning direction Y, ink droplets are ejected from the ejection surfaces 2*a* sequentially so that a color image is formed on the paper P. Ejecting operations of ink droplets are performed based on detection signals from a paper sensor 32. The paper P is then separated by the separation plate 5 and is conveyed upward by the two pairs of feed rollers 28. Further, the paper P is discharged onto the paper discharging section 31 through an opening 30 at the top of the apparatus.

Here, the sub-scanning direction Y is a direction parallel to the conveying direction of paper P by the conveying unit 21. The main scanning direction X is a direction parallel to a horizontal surface and perpendicular to the sub-scanning direction Y.

In the space C, an ink unit 1*c* is disposed so as to be detachable from the casing 1*a*. The ink unit 1*c* includes a cartridge tray 35 and four cartridges 40 arranged side by side within the cartridge tray 35. Each cartridge 40 supplies ink to a corresponding one of the heads 10 via an ink tube (not shown).

The configuration of the heads 10 will be described in greater detail with reference to FIGS. 2 through 5. Note that, in FIG. 3, pressure chambers 16 and apertures 15 are located below the actuator units 17 and should be strictly shown in dotted lines, but these are shown in the solid lines for simplicity in FIG. 3.

Figure 5:
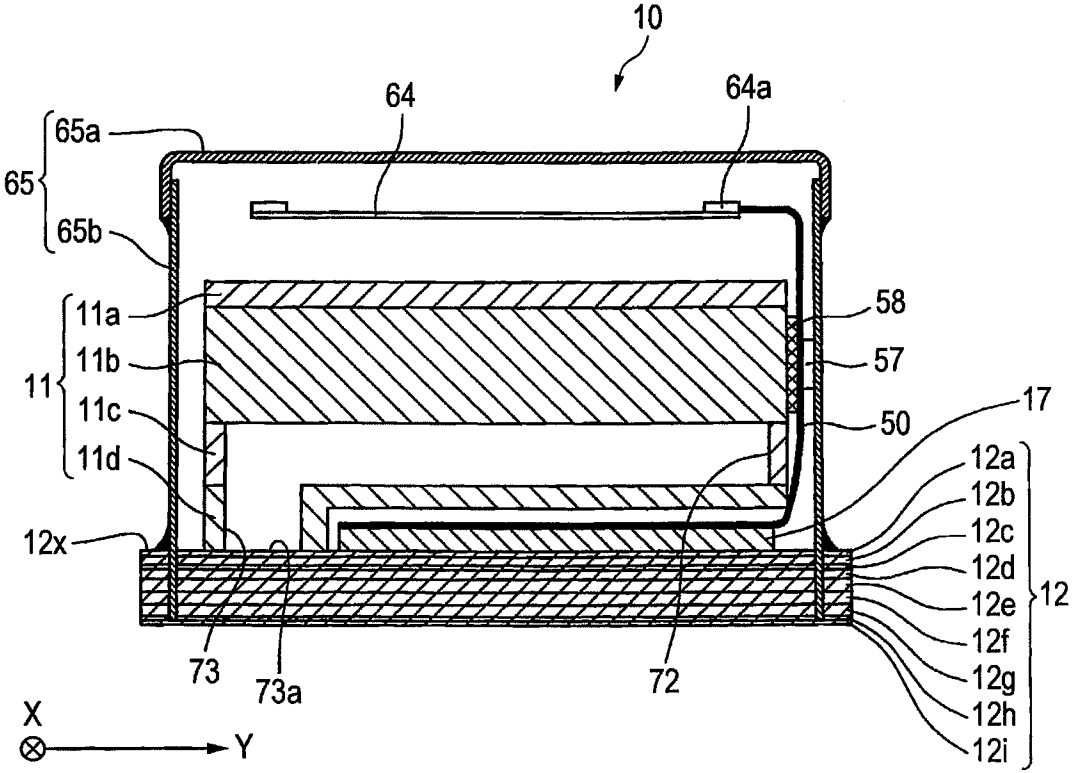
FIG. 5 is a vertical cross-sectional view of the inkjet head.

As shown in FIG. 5, the head 10 is a layered body in which the channel unit 12, the actuator unit 17, the reservoir unit 11, and a board 64 are stacked. Among these, the actuator unit 17, the reservoir unit 11, and the board 64 are accommodated in a space defined by an upper surface 12*x* of the channel unit 12 and a cover 65. In this space, a FPC (flat flexible print circuit board) 50 electrically connects the actuator unit 17 and the board 64. A driver IC 57 is mounted on the FPC 50.

As shown in FIG. 5, the cover 65 includes a top cover 65*a* and a side cover 65*b*. The cover 65 is a box which is opened downward, and is fixed to the upper surface 12*x* of the channel unit 12. Silicone materials are filled in the boundary between the both covers 65*a* and 65*b* and in the boundary between the side cover 65*b* and the upper surface 12*x*. The side cover 65*b* is made of an aluminum plate and also functions as a heat-sink. The driver IC 57 abut on the inner surface of the side cover 65*b* and is thermally coupled to the side cover 65*b*. Note that, in order to ensure the thermal coupling, the driver IC 57 is urged by an elastic member 58 (for example, a sponge) fixed to the side surface of the reservoir unit 11 toward the side cover 65*b* side.

The reservoir unit 11 is a layered body in which four metal plates 11*a*-11*d* formed with through holes and concave portions are bonded with one another. An ink channel is formed inside the reservoir unit 11. The plate 11*c* is formed with a reservoir 72 that temporarily stores ink. One end of the ink channel is connected to the cartridge 40 via a tube or the like, whereas the other end opens in the lower surface of the reservoir unit 11. As shown in FIG. 5, the lower surface of the plate 11*d* is formed with concavities and convexities. The concavities provide spaces between the plate 11*d* and the upper surface 12*x*. The actuator unit 17 is fixed to the upper surface 12*x* in this space. A certain gap is formed between the concavities of the lower surface of the plate 11*d* and the FPC 50 on the actuator unit 17. The plate 11*d* is formed with an ink outflow channel 73 (a part of the ink channel of the reservoir unit 11) in fluid communication with the reservoir 72. The ink outflow channel 73 opens in an end surface of the convex portion of the lower surface of the plate 11*d* (that is, the surface bonded with the upper surface 12*x*).

Figure 2:
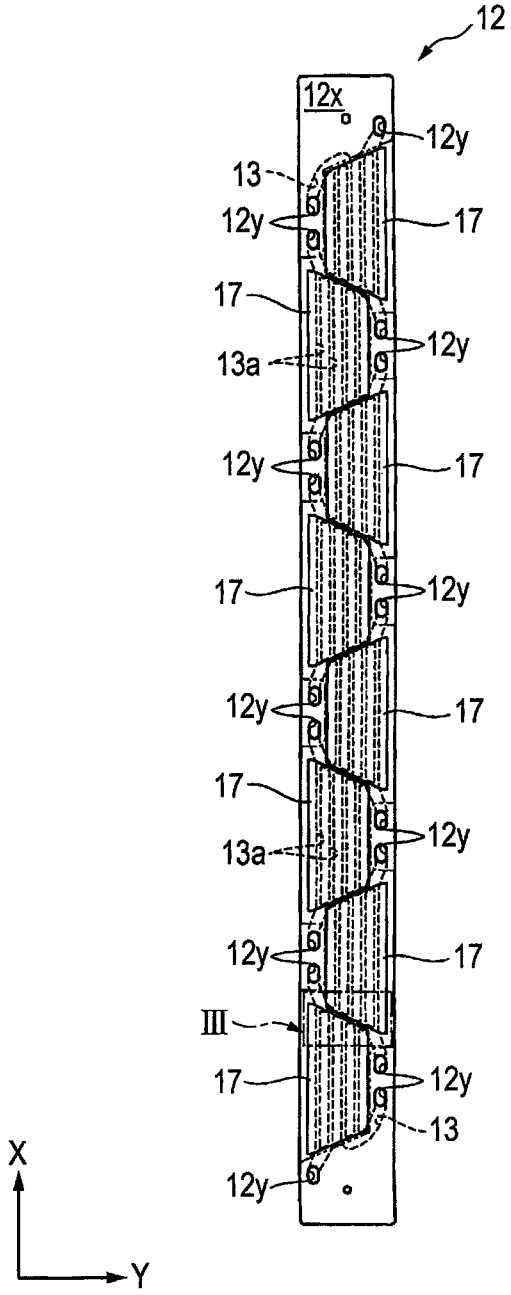
FIG. 2 is a plan view showing a channel unit and actuator units of an inkjet head included in the printer of FIG. 1.
Figure 3:
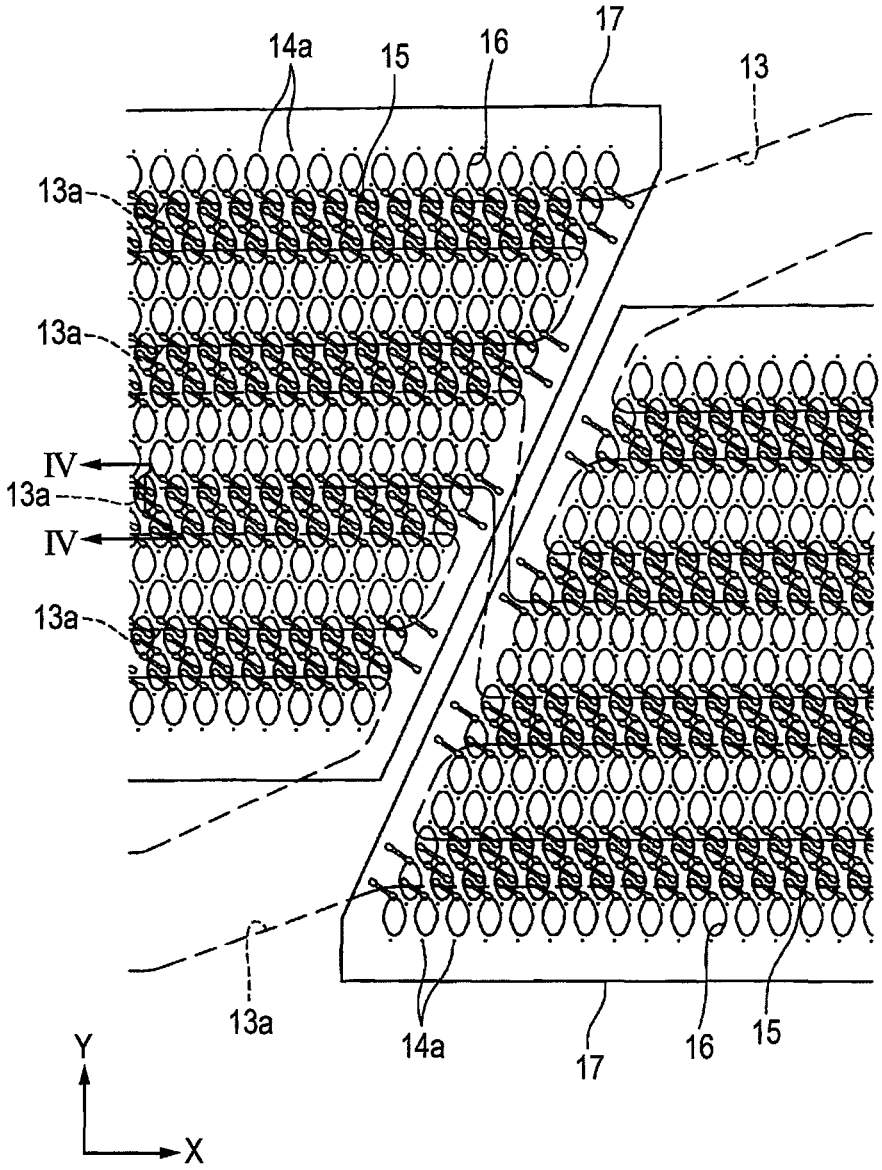
FIG. 3 is an enlarged view showing a region III surrounded by the single-dot chain line in FIG. 2.
Figure 4:
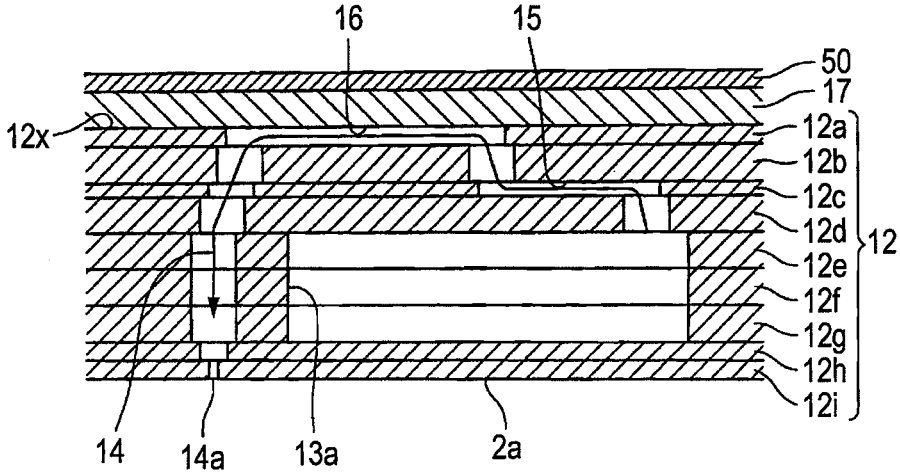
FIG. 4 is a partial cross-sectional view along a line IV-IV in FIG. 3.

The channel unit 12 is a layered body in which nine rectangular-shaped metal plates 12*a*, 12*b*, 12*c*, 12*d*, 12*e*, 12*f*, 12*g*, 12*h*, and 12*i* having substantially the same size (see FIG. 4) are bonded with one another. As shown in FIG. 2, the upper surface 12*x* of the channel unit 12 is formed with openings 12*y* in confrontation with a corresponding one of openings 73*a* of the ink outflow channel 73. Within the channel unit 12, ink channels are formed to connect from the openings 12*y* to ejection ports 14*a*. As shown in FIGS. 2, 3, and 4, the ink channel includes a manifold channel 13 having the opening 12*y* at one end thereof, subsidiary manifold channels 13*a* branching off from the manifold channel 13, and individual ink channels 14 running from outlets of the subsidiary manifold channels 13*a* via the pressure chambers 16 to the ejection ports 14*a*. As shown in FIG. 4, the individual ink channel 14 is formed for each ejection port 14*a*, and includes an aperture 15 functioning as an aperture for adjusting channel resistance. In addition, a large number of the pressure chambers 16 opens in the upper surface 12*x*. The opening of each pressure chamber 16 has substantially a diamond shape. The openings of the pressure chambers 16 are arranged in a matrix configuration so as to form a total of eight pressure-chamber groups each occupying substantially a trapezoidal region in a plan view. Like the pressure chambers 16, the ejection ports 14*a* opening in the ejection surface 2*a* are arranged in a matrix configuration so as to form a total of eight ejection-port groups each occupying substantially a trapezoidal region in a plan view.

As shown in FIG. 2, each actuator unit 17 has a trapezoidal shape in plan view. The actuator units 17 are arranged in a staggered configuration (in two rows) on the upper surface 12*x* of the channel unit 12. Further, as shown in FIG. 3, each actuator unit 17 is arranged on a trapezoidal region occupied by a pressure-chamber group (ejection-port group). For each of the actuator units 17, the lower base of a trapezoidal shape is located adjacent to an end of the channel unit 12 in the sub-scanning direction Y. The actuator units 17 are arranged so as to avoid a convex portion of the lower surface of the reservoir unit 11. The lower base of the trapezoidal shape of each actuator unit 17 is interposed between the openings 12*y* (the opening 73*a*) from the both sides in the main scanning direction X.

The FPC 50 is provided for each actuator unit 17. Wiring corresponding to each electrode of the actuator unit 17 is connected to a corresponding one of the output terminals of the driver IC 57. Under controls by the controller 1*p* (see FIG. 1), the FPC 50 transmits various driving signals adjusted in the board 64 to the driver IC 57, and transmits each driving potential generated by the driver IC 57 to the actuator unit 17. The driving potential is selectively applied to each electrode of the actuator unit 17.

Next, the configuration of the actuator unit 17 will be described with reference to FIGS. 6A through 6C.

Figure 6A:
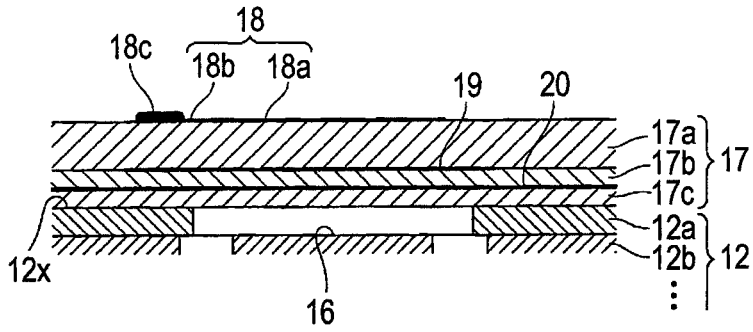
FIG. 6A is a partial cross-sectional view showing one of the actuator units of FIG. 2.

As shown in FIG. 6A, the actuator unit 17 includes a layered body of two piezoelectric layers 17*a* and 17*b*, and a vibration plate 17*c* arranged between the layered body and the channel unit 12. The piezoelectric layers 17*a* and 17*b* and the vibration plate 17*c* are all sheet-like members made of ceramic materials of lead zirconate titanate (PZT) series having ferroelectricity. The piezoelectric layers 17*a* and 17*b* and the vibration plate 17*c* have the same size and shape (trapezoidal shape) as viewed in the thickness direction of the piezoelectric layers 17*a* and 17*b* (the stacking direction in which the piezoelectric layers 17*a* and 17*b* are stacked). The vibration plate 17*c* seals openings of a pressure-chamber group (a large number of the pressure chambers 16) formed in the upper surface 12*x* of the channel unit 12. The thickness of the piezoelectric layer 17*a*, which is the outermost layer, is greater than a sum of the thickness of the piezoelectric layer 17*b* and the thickness of the vibration plate 17*c*. The piezoelectric layers 17*a* and 17*b* are polarized in the same direction along the stacking direction.

The upper surface of the piezoelectric layer 17*a* is formed with a large number of surface electrodes 18 corresponding to the respective ones of the pressure chambers 16. An internal electrode 19 is formed between the piezoelectric layer 17*a* and the piezoelectric layer 17*b* under the piezoelectric layer 17*a*. A common electrode 20 is formed between the piezoelectric layer 17*b* and the vibration plate 17*c* under the piezoelectric layer 17*b*. No electrode is formed on the lower surface of the vibration plate 17*c*.

Figure 6B:
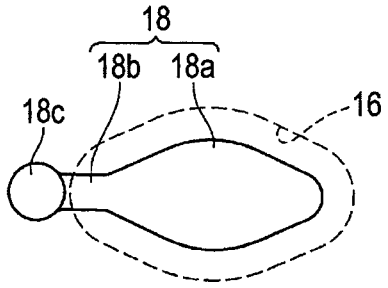
FIG. 6B is a plan view showing a surface electrode included in the actuator unit.

As shown in FIG. 6B, each surface electrode 18 includes a main electrode region 18*a* having substantially a diamond shape, an extension portion 18*b* extending from one of the acute angles of the main electrode region 18*a*, and a land 18*c* formed on the extension portion 18*b*. The shape of the main electrode region 18*a* is a similarity shape to that of the opening of the pressure chamber 16 and, in a plan view, the main electrode region 18*a* is arranged within the opening of the pressure chamber 16. The size of the main electrode region 18*a* is smaller than that of the opening of the pressure chamber 16. The extension portion 18*b* extends to a region outside of the opening of the pressure chamber 16, and the land 18*c* is arranged at a distal end of the extension portion 18*b*. The land 18*c* has a circular shape in a plan view, and does not confront the pressure chamber 16. The land 18*c* has a height of approximately 50 μm (micrometers) from the upper surface of the piezoelectric layer 17*a*. The land 18*c* is electrically connected to an electrode of wiring of the FPC 50. The piezoelectric layer 17*a* and the FPC 50 confront each other with a gap of approximately 50 μm (micrometers), at regions except the electrical connection point. With this configuration, free deformation of the actuator units 17 can be ensured.

Figure 6C:
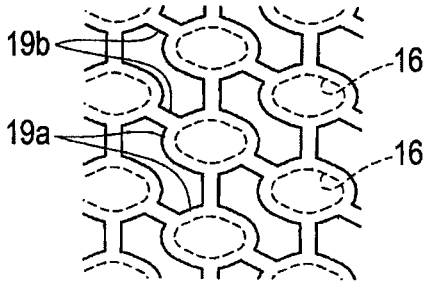
FIG. 6C is a plan view showing an internal electrode included in the actuator unit.

As shown in FIG. 6C, the internal electrode 19 includes a large number of individual portions 19*a* that confronts the respective ones of the openings of the pressure chambers 16, and a large number of connection portions 19*b* that connects the individual portions 19*a* with one another. The shape of each individual portion 19*a* is a similarity shape to that of the opening of the pressure chamber 16 as viewed in the stacking direction of the piezoelectric layers 17*a* and 17*b*, and the size of the individual portion 19*a* is larger than that of the opening of the pressure chamber 16. Each individual portion 19*a* is arranged to include the opening of the pressure chamber 16 (the dotted lines in FIG. 6C) therein. Because the individual portions 19*a* are connected by the connection portions 19*b*, the individual portions 19*a* are kept at the same electric potential.

The common electrode 20 is an electrode shared by all the pressure chambers 16 corresponding to one actuator unit 17. The common electrode 20 is formed on the entire surface of the vibration plate 17*c* and the piezoelectric layer 17*b*. With this configuration, an electric field that is generated in each of the piezoelectric layers 17*a* and 17*b* is insulated against the pressure chamber 16 side.

The upper surface of the piezoelectric layer 17*a* is formed with a land for the internal electrode (not shown) and a land for the common electrode (not shown). The land for the internal electrode is electrically connected to the internal electrode 19 via a through hole of the piezoelectric layer 17*a*. The land for the common electrode is electrically connected to the common electrode 20 via a through hole penetrating the piezoelectric layers 17*a* and 17*b*. Conductive material is filled within each through hole. In the upper surface of the piezoelectric layer 17*a*, the land for the internal electrode is arranged at substantially the center of each side of a trapezoidal shape, while the land for the common electrode is arranged near each corner of a trapezoidal shape. Each land is connected with a terminal of the FPC 50. Among these, the land for the common electrode is connected with a wiring connected to ground, and the land for the internal electrode is connected with a wiring extending from the output terminal of the driver IC 57.

Here, a part of each of the piezoelectric layers 17*a* and 17*b* functions as an active portion, the part being interposed between the electrodes 18, 19, and 20. The actuator unit 17 provides energy to ink within the pressure chamber 16 by deformation of the active portions of the piezoelectric layers 17*a* and 17*b* stacked vertically, the active portions being located at the position in confrontation with the opening of each pressure chamber 16 in a corresponding pressure-chamber group. The active portions stacked vertically are provided for each pressure chamber 16, and are capable of deforming independently for each pressure chamber 16. That is, the actuator unit 17 includes a piezoelectric-type actuator for each pressure chamber 16. Each active portion is displaced in at least one vibration mode selected from among $d_{31}$, $d_{33}$, and $d_{15}$ ($d_{31}$ in the present embodiment). A part of the vibration plate 17*c* does not deform by itself even when an electric field is applied, the part confronting the active portion in the stacking direction (inactive portion). In this way, the actuator of the present embodiment is a piezoelectric actuator of so-called unimorph type, where two active portions and one inactive portion are stacked. For example, if an electric field is applied in the same direction as the polarizing direction, the active portion of the piezoelectric layer 17*a* contracts in the surface direction by the piezoelectric lateral effect. However, the piezoelectric layer 17*b* and the vibration plate 17*c* do not deform by themselves, and function as layers that restrict displacement of the active portion of the piezoelectric layer 17*a*. At this time, because difference in deformation occurs between the both (the piezoelectric layer 17*a*, and the piezoelectric layer 17*b* and the vibration plate 17*c*), the actuator as a whole deforms to be convex toward the pressure chamber 16.

In the actuator unit 17, the two active portions stacked vertically have different roles from each other. That is, displacement in the active portion of the piezoelectric layer 17*a* contributes to ejection of ink droplets for image formation, whereas displacement in the active portion of the piezoelectric layer 17*b* contributes to vibrations of menisci. In this way, roles are different between the two active portions stacked vertically. It can also be said that each actuator is a layered body of two unimorph-type piezoelectric elements sharing the vibration plate 17*c*.

Figure 7A:
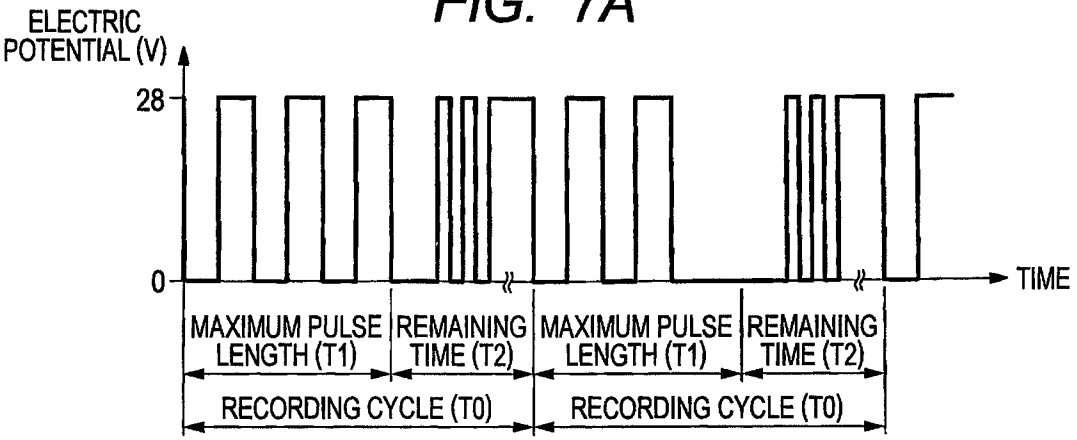
FIGS. 7A and 7B are graphs showing changes in electric potentials of the surface electrode and the internal electrode, respectively, during recording on one sheet of paper.

For image formation, the internal electrode 19 is used as a ground electrode, and only the piezoelectric layer 17*a* is driven (displaced). Before the controller 1*p* receives a print command, all the surface electrodes 18 are kept at an electric potential (for example, 28V as shown in FIG. 7A) that is different from the common electrode 20, and all the actuators included in the actuator unit 17 are kept in a deformed condition of being convex toward the pressure chamber 16. Upon receiving the print command, the controller 1*p* starts applying a driving voltage based on recording data. First, the surface electrode 18 is made to be a ground potential which is the same as the common electrode 20. At this time, the volume of the pressure chamber 16 increases so that ink supply is started from the subsidiary manifold channel 13*a* to the pressure chamber 16. Subsequently, at the timing when supplied ink reaches the pressure chamber 16, the surface electrode 18 is returned to an electric potential that is different from the common electrode 20. At this time, the actuator deforms to be convex toward the pressure chamber 16. Thus, the volume of the pressure chamber 16 decreases and pressure applied to ink within the pressure chamber 16 increases, which causes the ink to be ejected from the ejection port 14*a* as an ink droplet. When an operation of ejecting an ink droplet based on recording data is completed within one recording cycle T0, an operation of vibrating a meniscus is performed subsequently.

Next, non-ejection flushing and preliminary ejection in the printer 1 will be described.

The "non-ejection flushing" is an operation of driving the actuator unit 17 and vibrating a meniscus formed in the ejection port 14*a* without ejecting an ink droplet from the ejection port 14*a*. The "preliminary ejection" is an operation of driving the actuator unit 17 and ejecting an ink droplet from the ejection port 14*a*, thereby discharging ink with increased viscosity in the ejection port 14*a*. The both operations contribute to reproduction and maintenance of menisci.

The "non-ejection flushing" and the "preliminary ejection" are performed by supplying of a non-ejection driving voltage and a preliminary-ejection driving voltage, respectively, to the actuator unit 17 by the controller 1*p*.

The "non-ejection flushing" is performed during recording onto one sheet of paper P, and between sheets of paper P. The phrase "during recording onto one sheet of paper P" indicates a period in which one sheet of paper P being conveyed based on controls by the controller 1*p* is in confrontation with the ejection ports 14*a* of each head 10. The phrase "between sheets of paper P" indicates a period in which, when two or more sheets of paper P are conveyed continuously, no sheet of paper P is in confrontation with the ejection ports 14*a* of the head 10 after recording onto a previous sheet of paper P is finished and before recording onto a subsequent sheet of paper P is performed, the previous sheet and the subsequent sheet of paper P being two sheets of paper P arranged in the conveying direction.

During recording onto one sheet of paper P, the controller 1*p* generates an ejection driving signal and a non-ejection driving signal based on recording data, and supplies the actuator unit 17 with an ejection driving voltage and a non-ejection driving voltage corresponding to the ejection and non-ejection driving signals, respectively. The ejection driving voltage is applied between the surface electrode 18 and the internal electrode 19, and the non-ejection driving voltage is applied between the internal electrode 19 and the common electrode 20. The common electrode 20 is always kept at a ground potential. Each of the both driving voltages includes a rectangular-shaped and pulse-shaped voltage pulse that changes between a low level (0V: ground potential) and a high level (28V, for example) with a predetermined time width. Each of the both driving voltages is formed by voltage changes of the surface electrode 18 and the internal electrode 19 shown in FIGS. 7A and 7B, respectively.

Here, the "voltage pulse" is a rectangular-shaped and pulse-shaped voltage changing part from rising to falling of the voltage with a time width therebetween, and the time width is the "pulse width". Because the present embodiment adopts a pull and eject method as the method for driving the actuator, as shown in FIG. 7A, a discharging period of electric charge on the surface electrode 18 (a time period in which the surface electrode 18 is made to be a ground potential) is provided immediately prior to the start of application of the ejection driving voltage pulse to the piezoelectric layer 17*a*. Accumulation of electric charge (charging) in the electrodes is performed during application of voltage pulses. Here, the pulse width of a voltage pulse (charging period) and the discharging period are set to the same value.

In the ejection driving voltage, "maximum pulse length T1" is a time period required for applying ejection driving voltage pulses for ejecting a maximum amount of ink droplets (three droplets in the present embodiment). Further, "remaining time T2" is a time period that remains after the maximum pulse length T1 ends in the recording cycle T0.

Figure 7B:
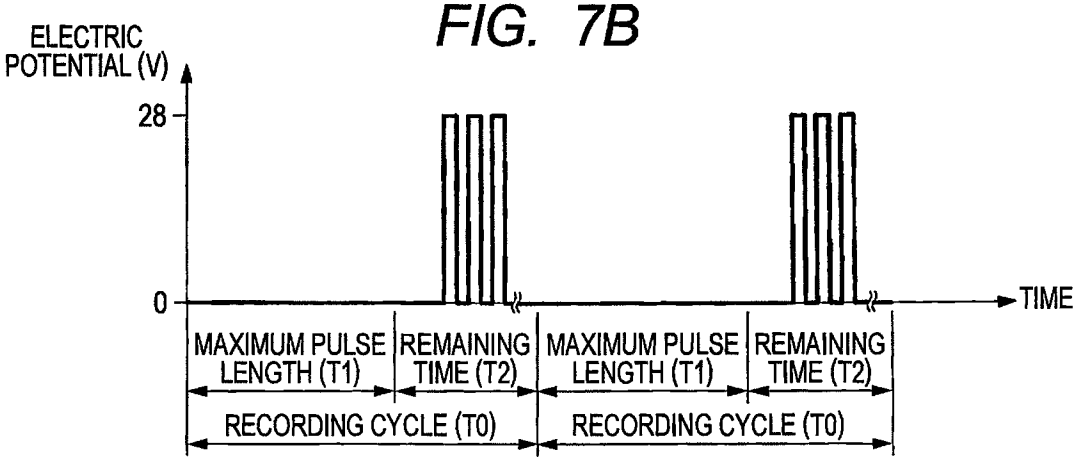

One recording cycle T0 is divided temporally into a former part (a time period of the maximum pulse length T1) and a latter part (a time period of the remaining time T2). In the former part, the surface electrode 18 and the internal electrode 19 are applied with such electric potentials that voltage pulses contributing to ejection of ink droplets are applied to the piezoelectric layer 17*a*. In the latter part, the surface electrode 18 and the internal electrode 19 are applied with such electric potentials that voltage pulses contributing to meniscus vibration (non-ejection flushing) are applied to the piezoelectric layer 17*b*. The electric potential of the surface electrode 18 is at a high level (for example, 28V) at normal times (at the times except when recording, non-ejection flushing, preliminary ejection, and the like are performed). As shown in FIGS. 7A and 7B, three voltage pulses corresponding to three ejection ink droplets are applied to the piezoelectric layer 17*a* in the former part of the first (earlier) recording cycle T0, and two voltage pulses corresponding to two ejection ink droplets are applied to the piezoelectric layer 17*a* in the former part of the second (later) recording cycle T0. Other than these examples, a voltage pulse corresponding to zero or one ejection ink droplet can be applied to the piezoelectric layer 17*a* in the former part. That is, in the present embodiment, any of zero, one, two, and three (0, 1, 2, and 3) can be selected for the number of ink droplets to be ejected from each ejection port 14*a*. Immediately prior to application of each voltage pulse, a time period is provided during which the electrodes 18 and 19 are at ground potentials. The last voltage pulse of the former part ends at a low level, and leads to the latter part. In each of the electrodes 18 and 19, potential controls in the latter part are common in each recording cycle T0, and a plurality of voltage pulses with small pulse width is arranged. In each latter part, a first voltage pulse appears in a constant time period after the starting time of the latter part, regardless of the electrodes 18 and 19 and the recording cycle T0.

The non-ejection driving voltage is applied to the piezoelectric layer 17*b* only in the latter part of each recording cycle T0. The non-ejection driving voltage includes a plurality (three in FIGS. 7A and 7B) of voltage pulses with small pulse width. The internal electrode 19 is kept at ground potential in the former part. The three voltage pulses constituting the non-ejection driving voltage have a smaller pulse width than the ejection driving voltage pulses and higher frequency than the ejection driving voltage pulses. The pulse width of voltage pulses of the non-ejection driving voltage is set to the same as a discharging period. The timing at which the first voltage pulse of the non-ejection driving voltage appears is synchronous with the timing of the first potential change of the surface electrode 18 in the latter part. Note that, however, as to potential changes of the third (the last) voltage pulse in the both electrodes 18 and 19, the electric potential of the internal electrode 19 falls after a pulse width, whereas the electric potential of the surface electrode 18 remains at a high level and leads to the next recording cycle T0.

Here, potential changes in the latter part of each recording cycle T0 are approximately the same in the both electrodes 18 and 19. In other words, during a period in which the non-ejection driving voltage is applied to the piezoelectric layer 17*b*, the surface electrode 18 and the internal electrode 19 are driven at the same potential relative to the common electrode 20. Because no electric field is generated in the piezoelectric layer 17*a*, the piezoelectric layer 17*a* is not displaced by itself, like the vibration plate 17*c*. On the other hand, an electric field is generated in the piezoelectric layer 17*b*, and its active portion is displaced. This active portion also repeats displacement in the vibration mode $d_{31}$ (displacement based on the piezoelectric lateral effect). Because difference in distortion is generated between the piezoelectric layer 17*b* and the other layers 17*a* and 17*c* at this time, unimorph deformation occurs in the actuator and a meniscus vibrates. Note that, in the latter part, the electric potential of the surface electrode 18 is kept at a high level after the last falling edge of electric potential in the internal electrode 19. Hence, the piezoelectric layer 17*a* is displaced, and the actuator deforms to be convex toward the pressure chamber 16. Subsequently, until the next recording cycle T0 is started, the actuator is kept in a condition of being convex toward the pressure chamber 16.

As described above, the former part and the latter part in one recording cycle T0 function for a recording ejection operation and a non-ejection flushing operation, respectively. Further, the recording ejection operation and the non-ejection flushing operation are performed by different piezoelectric layers (the piezoelectric layer 17*a* and the piezoelectric layer 17*b*, respectively).

When continuous recording is performed on a plurality of sheets of paper P, the controller 1*p* performs controls so that non-ejection flushing is performed between sheets of paper P by applying the non-ejection driving voltage to at least the piezoelectric layer 17*b*. At this time, the piezoelectric layer 17*a* may be electrically float, or may be applied with the ejection driving voltage pulse for ejecting zero droplet (no droplet). In the former case, the piezoelectric layer 17*a* can be affected by induction voltage due to driving of the piezoelectric layer 17*b*. However, this voltage is small enough to be neglected for at least deterioration of piezoelectric performance. Because no electric field is generated in the piezoelectric layer 17*a* in the latter case (the latter case is adopted in the present embodiment), it is effective as a countermeasure for deterioration of piezoelectric performance. Although a meniscus vibrates at this time, no ink droplet is ejected.

The "preliminary ejection" is performed, for example, when no recording ejection operation (ejecting ink droplets from the ejection port 14*a* based on image data) is performed by the head 10 for a predetermined period or longer, and immediately prior to a restart of the recording ejection operation. During the preliminary ejection, such a state is maintained that a cap (not shown) covers the lower surface of the channel unit 12 at the maintenance position.

The preliminary-ejection driving voltage is applied to the piezoelectric layer 17*b* by generating the same potential change as the one in the first recording cycle T0 shown in FIG. 7A (the potential change for ejecting three droplets, that is, when the number of ejected ink droplets is the largest) in the surface electrode 18 and the internal electrode 19.

Specifically, if the controller 1*p* determines that no recording ejection operation is performed for a predetermined period or longer, the controller 1*p* moves the cap (not shown) relative to the head 10 so that the ejection surface 2*a* is covered by the cap located at a predetermined position within the printer 1 and the ejection ports 14*a* are protected by the cap. Then, the controller 1*p* supplies the actuator unit 17 with the preliminary-ejection driving voltage in a state where the ejection surface 2*a* is covered by the cap. At this time, the surface electrode 18 and the internal electrode 19 are driven by the same potential, and potential controls of the above-described recording cycle T0 (including the former part and the latter part) shown in FIG. 7A are performed repeatedly for the both electrodes 18 and 19. Because the both electrodes 18 and 19 are driven by the same potential at this time, no voltage is applied to the piezoelectric layer 17*a*, and the maximum electric field generated in the piezoelectric layer 17*a* is approximately zero, which is smaller than the maximum electric field generated in the piezoelectric layer 17*b*.

A potential difference occurs between the electrodes 19 and 20 by such potential controls, and ejection of ink droplets based on displacement of the piezoelectric layer 17*b* (preliminary ejection) is performed in the former part of the recording cycle T0. That is, when a voltage pulse is applied to the active portion of the piezoelectric layer 17*b*, difference in distortion is generated between the piezoelectric layer 17*b* being displaced, and the piezoelectric layer 17*a* and the vibration plate 17*c*, which causes the actuator to deform in a so-called unimorph type as a whole. In accordance with this deformation, the volume of the pressure chamber 16 changes and pressure energy is added to ink within the individual ink channel 14 including the pressure chamber 16, so that an ink droplet is ejected from the ejection port 14*a*. Ejected ink droplets are received in the cap, and discharged into the waste ink reservoir or the like from the cap.

Next, hardware configurations of the controller 1*p* and functions of the controller 1*p* achieved by programs will be described.

The controller 1*p* includes a CPU (Central Processing Unit), a ROM (Read Only Memory), a RAM (Random Access Memory: including non-volatile RAM), ASIC (Application Specific Integrated Circuit), I/F (Interface), I/O (Input/Output Port), and the like. The ROM stores programs executed by the CPU, various constant data, and the like. The RAM temporarily stores data (image data, for example) that are required when the programs are executed. The ASIC performs rewriting, rearrangement, etc. of image data (signal processing and image processing). The I/F transmits data to and receives data from a higher-level device. The I/O performs input/output of detection signals of various signals. Each functioning section of the controller 1*p* is achieved by cooperation between these hardware configurations and the programs in the ROM.

Figure 8:
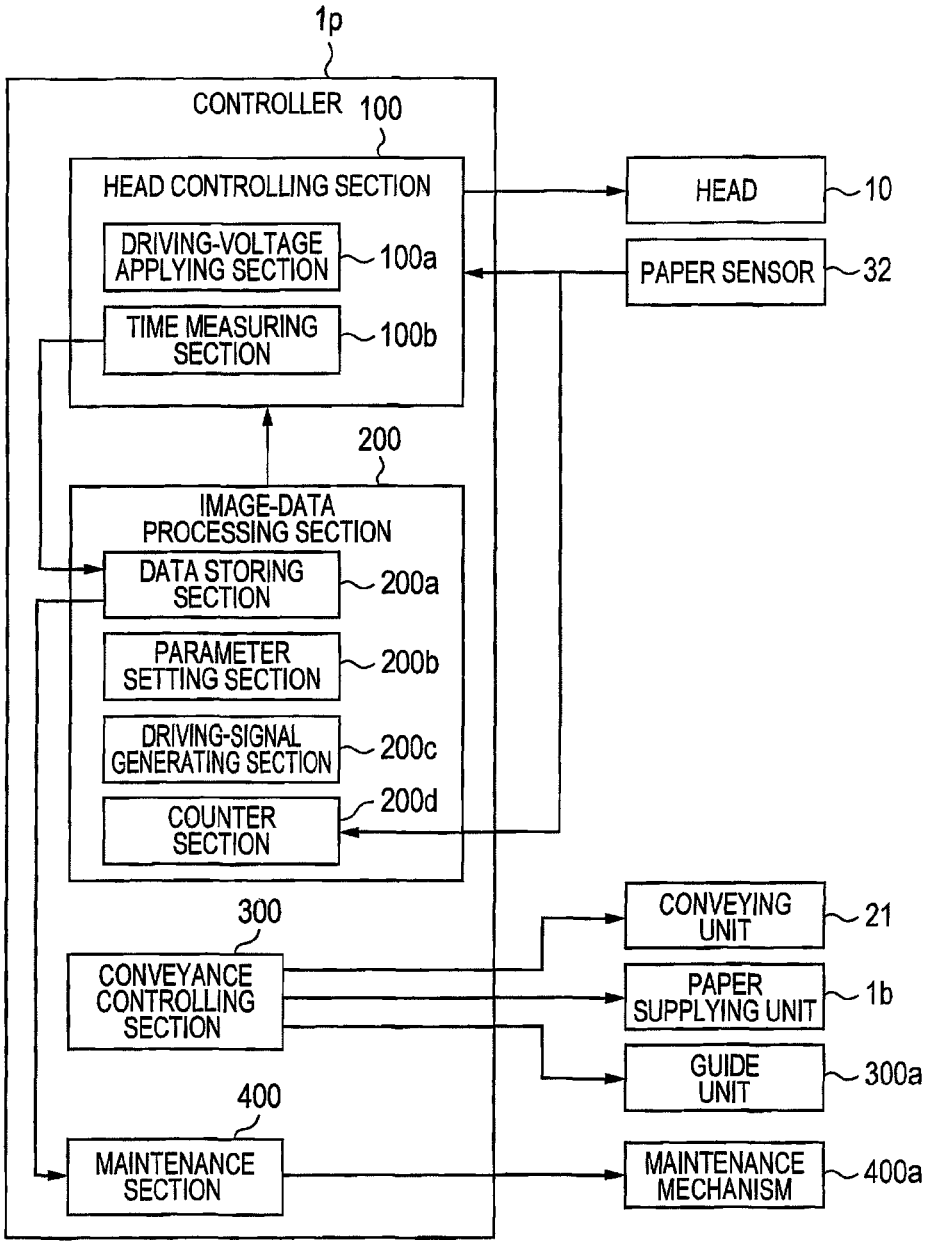
FIG. 8 is a block diagram showing functioning sections of a controller of the printer.

Among the functioning sections of the controller 1*p*, sections relating to image formation are a head controlling section 100, an image-data processing section 200, a conveyance controlling section 300, a maintenance section 400 shown in FIG. 8, and the like.

The head controlling section 100 includes a driving-voltage applying section 100*a* and a time measuring section 100*b*, and controls driving of the actuator unit 17 of the head 10.

The driving-voltage applying section 100*a* amplifies a driving signal obtained from the image-data processing section 200 (non-ejection driving signal, ejection driving signal, and preliminary-ejection driving signal) thereby generating a driving voltage including voltage pulses (non-ejection driving voltage, ejection driving voltage, and preliminary-ejection driving voltage), and outputs the driving voltage to the actuator unit 17. This output is performed for each recording cycle T0. In the present embodiment, the driving-voltage applying section 100*a* controls two lines of output ends, corresponding to two active portions stacked vertically. The non-ejection driving voltage pulse has a pulse width in a range that does not cause an ink droplet to be ejected from the ejection port 14*a*. The non-ejection driving voltage pulse is formed by voltage changes between 0V (ground potential) and 28V, like the ejection driving voltage pulse. When the non-ejection driving voltage pulse is applied, a meniscus in the ejection port 14*a* vibrates. The ejection driving voltage pulse has a voltage and a pulse width in a range that causes an ink droplet to be ejected from the ejection port 14*a*. Between sheets of paper P and during image formation on one sheet of paper P, the ejection driving voltage pulse is outputted to one of the two lines, and the non-ejection driving voltage pulse is outputted to the other one of the two lines. The timings of outputting these voltages are determined based on detection signals from the paper sensor 32. The preliminary-ejection driving voltage pulse has the same voltage and pulse width as the ejection driving voltage pulse used when the number of ejected ink droplets (the amount of ejected ink droplets) is the maximum. The output timing of the preliminary-ejection driving voltage is when the printer 1 is powered on, when the printer 1 is left unoperated for a predetermined period, and the like.

Note that one recording cycle T0 is a time period required for paper P to move relative to the head 10 by a unit distance corresponding to the resolution of an image to be recorded on paper P.

The time measuring section 100*b* measures a time period that has elapsed after detection of paper P, based on detection signal from the paper sensor 32. Based on this measurement result, a meniscus vibrating operation immediately before recording is stopped, and thereafter a recording operation is started. Further, the time measuring section 100*b* measures a time period that has elapsed after the previous print job. To enable this measurement, the time measuring section 100*b* outputs temporal information on the time point of ending of the print job to a data storing section 200*a* (described later).

The image-data processing section 200 generates driving signals of the actuator unit 17 and outputs the signals to the head controlling section 100. The image-data processing section 200 includes the data storing section 200*a*, a parameter setting section 200*b*, a driving-signal generating section 200*c*, and the like.

The data storing section 200*a* stores image data supplied via the I/F, the results (recording data) obtained by performing signal processing and image processing on image data, and the like. The recording data are data that associate arrangement of the ejection ports 14*a* and pixel arrangement on paper P, and indicate the number of ink droplets (the amount of ink droplets) for each recording cycle T0 forming each pixel. In addition, the data storing section 200*a* stores information outputted from the parameter setting section 200*b* (temporal information such as elapsed period, elapsed time, paper supply interval etc. to be described later), temporal information on the time point of ending of the print job outputted from the time measuring section 100*b*, and the like.

The parameter setting section 200*b* performs settings of the number of printed sheets in the print job, the elapsed period from the previous print job, the elapsed time after detection of paper, the paper supply interval, and the like. The temporal information of the elapsed period, the elapsed time, the paper supply interval, etc. is an indicator for switching operations of a recording process. The number of printed sheets is determined based on stored image data. The data of the above-mentioned elapsed period, the elapsed time, the paper supply interval, etc. are predetermined. The parameter setting section 200*b* reads out these data from the ROM after a power-on of the printer 1, and temporarily stores the setting values in the RAM. The number of printed sheets is updated each time image formation is completed on a sheet of paper P, based on the count results of a counter section 200*d* to be described later.

The driving-signal generating section 200*c* generates the ejection driving signal, the non-ejection driving signal, and the preliminary-ejection driving signal. The ejection driving signal is a pulse signal that is generated from driving signal data in the ROM based on recording data. There are a plurality of kinds of ejection driving signals according to the number of tones (the number of ejected ink droplets). The number of voltage pulses included in the ejection driving signal of each recording cycle T0 is the same as the number of ejected ink droplets in one recording cycle T0. For example, if one pixel is formed by three ink droplets, driving signal data including three voltage pulses are used. In the present embodiment, there are four kinds of ejection driving signals of which the number of ejected ink droplets are zero to three. The pulse width is set to AL (Acoustic Length: time length of one-way propagation of a pressure wave in the individual ink channel 14). The non-ejection driving signal is a pulse signal that is generated from driving signal data in the ROM, and indicates the number of meniscus vibration for each recording cycle T0. In the present embodiment, the first voltage pulse of the non-ejection driving voltage appears at the timing following the last voltage pulse included in the ejection driving voltage for ejecting the maximum number of ink droplets (the maximum amount of ink). The non-ejection driving signal includes a plurality of voltage pulses for vibrating a meniscus (for non-ejection driving), and has a higher frequency than the ejection driving signal. Further, the pulse width of non-ejection driving voltage pulse (for example, 2 microseconds) is smaller than a voltage pulse of the ejection driving signal. The preliminary-ejection driving signal is a pulse signal that is generated from data in the ROM, and indicates the number of ejected ink droplets for each recording cycle T0. Each driving signal is supplied to the driving-voltage applying section 100*a* of the head controlling section 100.

The counter section 200*d* counts the number of sheets of paper P supplied for image formation (that is, on which recording has been done), based on detection signal from the paper sensor 32. This count result is sent to the parameter setting section 200*b*, and the parameter setting section 200*b* updates the setting value of the number of printed sheets.

The conveyance controlling section 300 controls driving of each motor relating to conveyance (the conveying motor, the feed motor, and the paper supplying motor), so that paper P is conveyed along the paper conveying path. When the controller 1*p* receives a print command, the conveyance controlling section 300 starts driving the conveying motor and the feed motor. Then, after the paper conveying speed reaches a predetermined value, the conveyance controlling section 300 starts driving the paper supplying motor. At this time, paper P is conveyed with a predetermined time interval.

The maintenance section 400 controls the maintenance mechanism 400*a* so as to perform maintenance operations of preliminary ejection, purging, wiping, capping, and the like. The maintenance section 400 controls driving of the ink forceful supplying pump and the ink discharging pump, relative movement of the wiper and the cap relative to the ejection surface 2*a* of the head 10, and the like. The maintenance section 400 performs preliminary ejection, or purging and wiping as necessary, immediately after the printer 1 is powered on. The preliminary ejection is an ink discharging operation by driving of the actuator unit 17. The preliminary ejection is automatically executed when the standby time reaches a predetermined period or more, even after the printer 1 is powered on. In contrast, purging is an operation of discharging ink from the ejection port 14*a* by driving the ink forceful supplying pump to supply ink in the channel unit 12 forcefully, not by driving the actuator unit 17. Ink discharged by preliminary ejection and purging is received in the cap, and is discharged to the waste ink reservoir by driving of the ink discharging pump. Wiping is an operation of wiping out foreign matters (residual ink etc.) on the ejection surface 2*a* after purging by relatively moving the wiper in contact with the ejection surface 2*a*. Capping is an operation of protecting the ejection ports 14*a* by the cap, and is performed at the times when a print job ends and when the power of the printer 1 is turned off.

Figure 9:
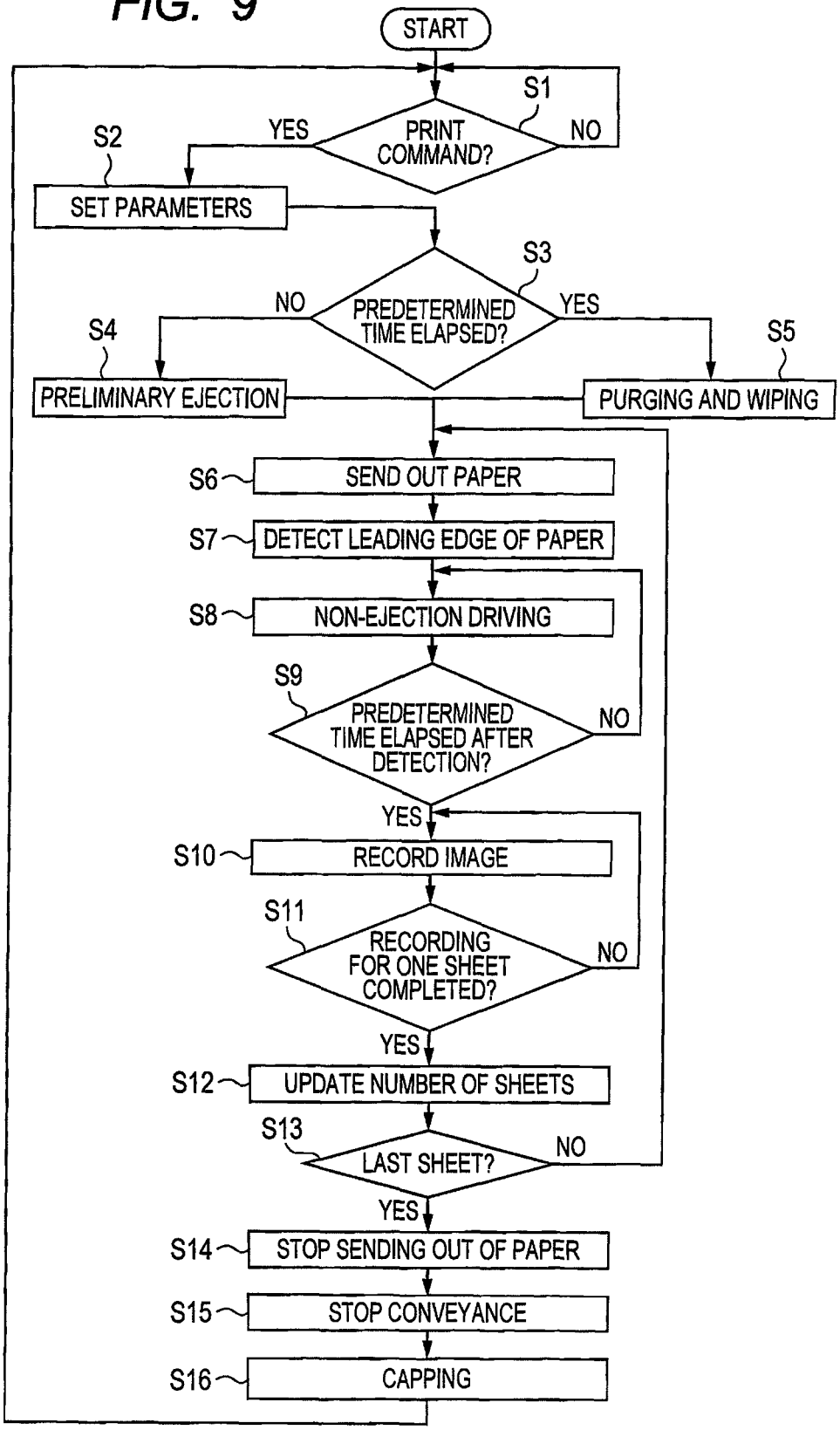
FIG. 9 is a flowchart for explaining processes of a recording operation performed by the controller of the printer.

Next, a process for a recording operation performed by the controller 1*p* will be described with reference to FIG. 9. Hereinafter, "Step" will be abbreviated as "S". When the printer 1 is powered on, the controller 1*p* (see FIG. 8) having the above-described functioning sections is set up. Then, as shown in FIG. 9, the controller 1*p* determines whether a print command is inputted (S1). If no print command is inputted (S1: No), then the controller 1*p* continues a standby state. If a print command is inputted (S1: Yes), then the controller 1*p* moves to processing of S2.

In S2, the parameter setting section 200*b* reads out each setting value from the ROM, and performs settings of the above-mentioned parameters (the number of printed sheets, elapsed period, elapsed time, paper supply interval, etc.). These set data are stored in the data storing section 200*a*.

Subsequent to S2, the controller 1*p* determines whether a predetermined time has elapsed based on the elapsed period from the previous print job measured by the time measuring section 100*b* (S3). The time measuring section 100*b* measures the elapsed period based on information on a time point at which the previous print job ends and on information on a time point at which the print command is inputted, the both information being stored in the non-volatile RAM. If the controller 1*p* determines that the predetermined time has not elapsed (S3: No), then the controller 1*p* moves to processing of S4. If the controller 1*p* determines that the predetermined time has elapsed (S3: Yes), then the controller 1*p* moves to processing of S5.

In S4, preliminary ejection is performed. The driving-voltage applying section 100*a* outputs, to the actuator unit 17, the preliminary-ejection driving voltage that is generated based on a preliminary-ejection driving signal obtained from the driving-signal generating section 200*c*. The period of this output (the number of the recording cycle T0) is determined preliminarily. This preliminary-ejection driving voltage is applied to the piezoelectric layer 17*b*. At this time, together with the above-mentioned voltage application, the maintenance section 400 drives the ink discharging pump to discharge, to the waste ink reservoir, ink discharged by preliminary ejection and received in the cap. With preliminary ejection, ink with increased viscosity in the ejection port 14*a* is discharged and ejection performance is recovered. Further, because the preliminary-ejection driving voltage includes a plurality of voltage pulses with small pulse width in the latter part of the recording cycle T0 (see the latter part of the first recording cycle T0 in FIG. 7A), vibration of menisci is performed in the latter part. Subsequently, after the maintenance section 400 moves the cap to a standby position that does not confront the ejection surface 2*a*, the controller 1*p* moves to processing of S6.

In S5, the maintenance section 400 controls the maintenance mechanism 400*a* so as to perform purging and wiping. The maintenance section 400 first drives the ink forceful supplying pump to forcefully supply ink into the channel unit 12 and discharge a predetermined amount of ink through the ejection port 14*a* (purging). The maintenance section 400 then drives the ink discharging pump to discharge, to the waste ink reservoir, ink discharged by purging and received in the cap. Subsequently, the maintenance section 400 moves the cap to the standby position where an operation of wiping out foreign matters on the ejection surface 2*a* is performed by the wiper (wiping). Ink with increased viscosity in the ejection port 14*a* and foreign matters (air bubbles etc.) in the channel unit are discharged by purging, and residual ink etc. on the ejection surface 2*a* is wiped out by wiping. Ink wiped out by wiping is received in a waste ink receiver (not shown) of the wiper mechanism, and is subsequently discharged to the waste ink reservoir. Recovery of ejection performance and cleaning of the ejection surface 2*a* are achieved by purging and wiping. Subsequently, the controller 1*p* moves to processing of S6.

In S6, the conveyance controlling section 300 performs controls of sending out of paper P. The conveyance controlling section 300 first drives the conveying motor and the feed motor and, when the conveying belt 8 reaches a predetermined moving speed, starts driving the paper supplying motor. At this time, the uppermost paper P in the paper supplying tray 23 is sent out. At continuous recording on a plurality of sheets, a plurality of sheets of paper P is sequentially sent out with a predetermined time interval. Paper P is first conveyed by the upstream-side guide section.

Approximately concurrently with a start of driving of the motors for conveyance in S6, an operation of detecting a leading edge of paper P is started (S7). That is, the paper sensor 32 detects the leading edge of paper P at an upstream part of the conveying belt 8. The detection signal by the paper sensor 32 is sent to the head controlling section 100 and the image-data processing section 200. Subsequently, the controller 1*p* moves to processing of S8.

In S8, non-ejection driving is performed. The driving-voltage applying section 100*a* outputs, to the actuator unit 17, the non-ejection driving voltage that is generated based on a non-ejection driving signal obtained from the driving-signal generating section 200*c*, at a timing based on the detection signal of the leading edge of paper P. This non-ejection driving voltage is applied to the piezoelectric layer 17*b*. At this time, the controller 1*p* performs controls so that the electric potentials of the surface electrode 18 and the internal electrode 19 relative to the common electrode 20 are the same. Hence, only the piezoelectric layer 17*b* is displaced, and menisci vibrate in all the ejection ports 14*a*. The piezoelectric layer 17*a* is not displaced by itself. Application of the non-ejection driving voltage may be continued until the start of image formation, or may be stopped prior to the start of image formation (the latter is adopted in the present embodiment so that vibration of menisci does not affect image formation).

Next, the controller 1*p* determines whether a predetermined time has elapsed after detection of paper P based on the elapsed time measured by the time measuring section 100*b* (S9). If the controller 1*p* determines that the predetermined time has not yet elapsed (S9: No), then the controller 1*p* continues vibration of menisci (non-ejection driving in S8). If the controller 1*p* determines that the predetermined time has elapsed (S9: Yes), then the controller 1*p* stops vibration of menisci and moves to processing of S10.

In S10, waiting for a certain period after vibration of menisci stops, the head controlling section 100 starts driving the head 10 based on recording data at a timing when a recording region of paper P comes in exact confrontation with the ejection surface 2*a*. Here, the driving-voltage applying section 100*a* applies the non-ejection driving voltage to the piezoelectric layer 17*b* and, at the same time, applies, to the piezoelectric layer 17*a*, the ejection driving voltage that is generated based on an ejection driving signal obtained from the driving-signal generating section 200*c*. Hence, in one recording cycle T0, ejection of ink droplets based on recording data (image formation) and vibration of menisci following the ejection are performed. During a period of ejection of ink droplets (that is, the former part of each recording cycle T0), the internal electrode 19 is kept at ground potential, and no electric field is applied to the piezoelectric layer 17*b*. In one recording cycle T0, the first voltage pulse for vibrating a meniscus is applied at the same timing regardless of kinds of the ejection driving signal. The first voltage pulse for vibrating a meniscus appears after the end of application of the last voltage pulse among a plurality of voltage pulses constituting the ejection driving voltage corresponding to the maximum amount of ink. Further, vibration of a meniscus is stopped with a sufficient period to attenuate residual vibration before the next recording cycle T0 starts.

The controller 1*p* starts monitoring of progress of recording concurrently with the start of processing of S10 and, if recording for one sheet of paper P is completed (S11: Yes), then the controller 1*p* moves to processing of S12. In S12, the parameter setting section 200*b* updates the number of printed sheets and stores the updated value in the RAM.

After S12, the controller 1*p* compares the updated value of the number of printed sheets stored in the RAM with an initial value, and determines whether the previously printed sheet is the last sheet, that is, all the recording based on the print command is completed (S13). If all the recording is not completed (S13: No), then the controller 1*p* returns to processing of S6 and repeats processing to S12. If all the recording is completed (S13: Yes), then the controller 1*p* moves to processing of S14.

In S14, the conveyance controlling section 300 stops the paper supplying motor so as to stop sending out of a new sheet of paper P. Then, after the printed sheer of paper P is discharged to the paper discharging section 31, the controller 1*p* stops driving the conveying motor and the feed motor so as to stop conveyance of paper P (S15). Further, the controller 1*p* controls the maintenance section 400 to perform capping (S16). That is, the maintenance mechanism 400*a* is driven so that the cap covers the ejection surface 2*a*. With the above-described operations, one print job is completed.

As described above, according to the printer 1 of the present embodiment, two piezoelectric layers of the piezoelectric layer 17*a* and the piezoelectric layer 17*b* having different roles of recording ejection operation and meniscus vibration (non-ejection flushing), respectively, are provided at a part in confrontation with each pressure chamber 16 of the actuator unit 17. Thus, the number of deformation of the piezoelectric layer for recording ejection operation due to voltage application can be reduced, compared with the case where one piezoelectric layer is used both for recording ejection operation and for non-ejection flushing. Hence, deterioration of piezoelectric performance of the piezoelectric layer for recording ejection operation can be suppressed, and thus deterioration of durability of the entire actuator unit 17 including the piezoelectric layers can be suppressed. Thus, according to the present embodiment, recording quality can be well kept by vibrating menisci, while suppressing deterioration of durability of the actuator unit 17.

Further, the piezoelectric layers 17*a* and 17*b* stacked in a direction perpendicular to the upper surface 12*x* of the channel unit 12 are used for recording ejection operation and for non-ejection flushing. Thus, compared with the case where these piezoelectric layers are arranged in juxtaposition along the upper surface 12*x* of the channel unit 12, upsizing of the printer 1 in a direction along the upper surface 12*x* of the channel unit 12 can be avoided.

As shown in FIG. 6B, the surface electrode 18 formed on the upper surface of the piezoelectric layer 17*a*, which is the outermost layer, has a similarity shape to the opening of the pressure chamber 16 and a smaller size than the opening, as viewed in the stacking direction of the piezoelectric layers 17*a* and 17*b*. Hence, due to the shape and size of the surface electrode 18 relative to the opening, deformation efficiency of the piezoelectric layer 17*a* can be improved. Hence, because the piezoelectric layer 17*a* is the outermost layer, alignment of the surface electrode 18 relative to the opening can be performed with a high precision and with ease. In addition, wiring to the surface electrode 18 can be performed with ease.

The piezoelectric layer 17*a* which is the outermost layer is for recording ejection operation, and the piezoelectric layer 17*b* arranged at a position closer to the upper surface 12*x* of the channel unit 12 is for non-ejection flushing. In this way, by using the piezoelectric layer 17*a* which is the outermost layer and thus highly efficient in deformation for the recording ejection operation purposes, ejection for recording can be performed efficiently and improvement in recording quality can be achieved.

As shown in FIG. 6C, the internal electrode 19 has a larger size than the opening of the pressure chamber 16 as viewed in the stacking direction of the piezoelectric layers 17*a* and 17*b*. According to this configuration, alignment of the internal electrode 19 relative to the opening can be performed with a high precision and with ease, even when the piezoelectric layers 17*a* and 17*b* on which the internal electrode 19 is formed are contracted due to burning. This increases deformation efficiency of the piezoelectric layer 17*b*, and a meniscus in each ejection port 14*a* can be vibrated reliably in non-ejection flushing.

As shown in FIG. 6C, the internal electrode 19 includes the plurality of individual portions 19*a* in confrontation with the respective ones of the openings of the pressure chamber 16, and the plurality of connection portions 19*b* connecting the individual portions 19*a* with one another. With this arrangement, wiring configuration for the internal electrode 19 can be simplified.

The actuator unit 17 includes the vibration plate 17*c* arranged between a layered body of the piezoelectric layers 17*a*, 17*b* and the channel unit 12 so as to close the openings of the pressure chambers 16. With this arrangement, in the actuator unit 17, it is possible to implement deformation of unimorph type, bimorph type, multimorph type, and the like, using the vibration plate 17*c*. Further, by interposing the vibration plate 17*c* between the layered body of the piezoelectric layers 17*a*, 17*b* and the channel unit 12, it is possible to prevent electrical defect such as short circuit that may occur due to migration of ink ingredient within the pressure chamber 16 when each of the piezoelectric layers 17*a* and 17*b* of the layered body is driven.

Among the electrodes 18 to 20 included in the actuator unit 17, the common electrode 20 closest to the upper surface 12*x* of the channel unit 12 is a ground electrode connected to ground. If the common electrode 20 is not electrically connected to ground, potential difference is created between ink within the pressure chamber 16 and the common electrode 20, and migration of ink ingredient within the pressure chamber 16 can generate short circuit. In the present embodiment, however, this problem can be avoided.

The common electrode 20 extends over the entirety of the surface of the piezoelectric layer 17*b*. With this arrangement, electrical defect caused by leakage electric field (for example, electrical short circuit due to electroendosmosis of ink ingredient in the pressure chamber 16) can be prevented.

The piezoelectric layers 17*a* and 17*b* are polarized in the same direction along the stacking direction. If the polarizing directions in the stacking direction of the piezoelectric layers 17*a* and 17*b* are opposite from each other, in addition to the common electrode 20 sandwiched between these two piezoelectric layers 17*a* and 17*b*, a cutoff electrode (an electrode connected to ground during both periods of recording ejection operation and non-ejection flushing) needs to be newly added in order to displace the piezoelectric layers 17*a* and 17*b* in the same direction. The cutoff electrode is an electrode connected to ground like the common electrode 20. The cutoff electrode cuts off, against ink, an electric field generated by the surface electrode 18 and the internal electrode 19 sandwiching the piezoelectric layers 17*a* and 17*b* with the common electrode 20. In this case, the added cutoff electrode function as a rigid body, and becomes a factor that hinders deformation of each active portion of the actuator unit 17. In contrast, in the present embodiment, there is only one ground electrode, which is the common electrode 20, thereby suppressing worsening of efficiency in deformation of the actuator unit 17.

The piezoelectric layers 17*a* and 17*b* are arranged adjacently with only the internal electrode 19, and no other piezoelectric layer, sandwiched therebetween in the stacking direction. In this arrangement, as shown in FIGS. 7A and 7B, the controller 1*p* (the driving-voltage applying section 100*a*) performs controls such that electric potentials of the internal electrode 19 and the surface electrode 18 relative to the common electrode 20 are the same, during a period in which no ejection driving signal is supplied (that is, in the latter part of each recording cycle T0 (the remaining time T2)). That is, in the remaining time T2 of each recording cycle T0, the timings of rising and falling of electric potentials and the potential values of the low level and the high level are identical between the internal electrode 19 and the surface electrode 18. Hence, because no electric field is generated in the piezoelectric layer 17*a* for recording ejection operation at the time of non-ejection flushing, deterioration of piezoelectric performance of the piezoelectric layer 17*a* can be suppressed more reliably.

As shown in FIGS. 7A and 7B, in one recording cycle T0, the controller 1*p* (the driving-voltage applying section 100*a*) applies voltage pulses corresponding to the non-ejection driving signal to the piezoelectric layer 17*b* after the last voltage pulse corresponding to the ejection driving signal is applied to the piezoelectric layer 17*a*. In this way, by performing non-ejection flushing in the recording cycle T0, ejection performance can be maintained and recording quality can be well kept more reliably.

As shown in FIGS. 7A and 7B, the controller 1*p* (the driving-voltage applying section 100*a*) applies voltage pulses corresponding to the non-ejection driving signal to the piezoelectric layer 17*b*, after an elapse of a time period required for applying voltage pulses corresponding to the ejection driving signal for ejecting the maximum amount of ink droplets among a plurality of kinds of ejection driving signals (that is, the maximum pulse length T1) from the starting time point of one recording cycle T0. Hence, voltage pulses corresponding to the non-ejection driving signal are applied to the piezoelectric layer 17*b* at predetermined timings, regardless of kinds of the ejection driving signal, which makes controls easier. Further, non-ejection flushing is performed at predetermined timings. Thus, even if residual vibration is generated by non-ejection flushing, influence of the residual vibration on the next recording cycle T0 is homogenized, and a constant recording quality can be maintained.

The controller 1*p* (the driving-voltage applying section 100*a*) applies voltage pulses corresponding to the non-ejection driving signal to the piezoelectric layer 17*b* between sheets of paper P during continuous recording. In this way, during continuous recording, non-ejection flushing is performed at a timing when sheets of paper P are switched, which is after recording on one sheet of paper P is finished and before recording on the next sheet of paper P is performed, thereby keeping good recording quality more reliably and efficiently.

The controller 1*p* (the driving-voltage applying section 100*a*) applies a constant voltage (0V) to the piezoelectric layer 17*b* for non-ejection flushing, during a period in which voltage pulses corresponding to the ejection driving signal are applied to the piezoelectric layer 17*a* for recording ejection operation (that is, during a period of the maximum pulse length T1). Thus, changes in voltage applied to the piezoelectric layer 17*a* for recording ejection operation can be suppressed.

The controller 1*p* generates the preliminary-ejection driving signal by the driving-signal generating section 200*c* and, by the driving-voltage applying section 100*a*, applies voltage pulses corresponding to the preliminary-ejection driving signal to the piezoelectric layer 17*b* so that the maximum electric field generated in the piezoelectric layer 17*a* is smaller than the maximum electric field generated in the piezoelectric layer 17*b*. By preliminary ejection of the preliminary-ejection driving signal, reproduction of menisci can be performed. Further, by suppressing an electric field generated in the piezoelectric layer 17*a* for recording ejection operation at the time of preliminary ejection, deterioration of piezoelectric performance of the piezoelectric layer for recording ejection operation can be suppressed more reliably.

As shown in FIGS. 7A and 7B, the non-ejection driving signal has a higher frequency than the ejection driving signal. Thus, menisci can be vibrated efficiently at non-ejection flushing. In other words, because non-ejection flushing can be performed efficiently in a short period, shortening of the entire recording period, that is, high-speed recording can be achieved.

While the invention has been described in detail with reference to the above aspects thereof, it would be apparent to those skilled in the art that various changes and modifications may be made therein without departing from the scope of the claims.

The arrangement and shape of the piezoelectric layers and electrodes included in the actuator as well as the deformation mode of the actuator are not limited to those described in the above embodiment and may be modified in various ways.

Figure 10:
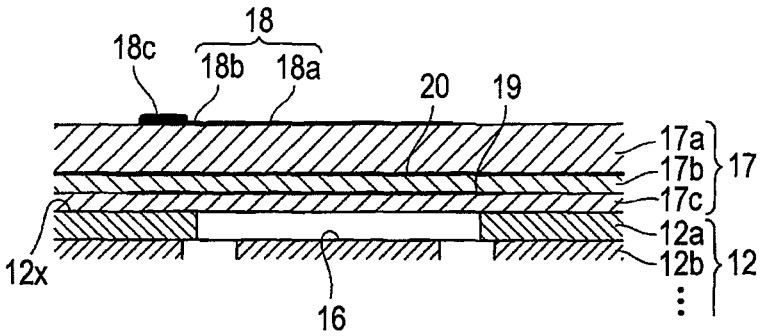
FIG. 10 is a partial cross-sectional view showing an actuator unit included in an inkjet-type printer according to a modification.

For example, like a modification shown in FIG. 10, the internal electrode 19 and the common electrode 20 may be switched. That is, in this modification, the common electrode 20, which is ground electrode, is arranged between the piezoelectric layers 17*a* and 17*b*, and the internal electrode 19 is arranged between the piezoelectric layer 17*b* and the vibration plate 17*c*. This configuration has an advantage that controls are easy. Specifically, because the common electrode 20 is interposed between the piezoelectric layers 17*a* and 17*b*, it is not necessary to drive the surface electrode 18 at the same potential as the internal electrode 19 so as not to generate an electric field in the piezoelectric layer 17*a* for recording ejection operation at the time of non-ejection flushing, and it is possible to drive the surface electrode 18 and the internal electrode 19 independently from each other.

It is not necessary that each surface electrode 18 has a similarity shape to the shape of the opening of the pressure chamber 16 and has a size smaller than the opening as viewed in the stacking direction of the piezoelectric layers 17*a* and 17*b*. As long as the surface electrodes 18 are arranged to confront the pressure chambers 16, the surface electrodes 18 may have various shapes and sizes.

As shown in FIG. 6C, each individual portion 19*a* of the internal electrode 19 has a similarity shape to the opening of the pressure chamber 16 as viewed in the stacking direction of the piezoelectric layers 17*a* and 17*b*. However, the shape is not limited to this design. For example, it may be so configured that the individual portion 19*a* is not a similarity shape to the opening of the pressure chamber 16. As long as the individual portion 19*a* has a size larger than the opening, alignment of the individual portion 19*a* relative to the opening can be performed with a high precision and with ease, when the piezoelectric layers 17*a* and 17*b* on which the internal electrode 19 is formed are contracted due to burning. Further, it may be so configured that each individual portion 19*a* of the internal electrode 19 does not have a size larger than the opening of the pressure chamber 16. Further, it is not necessary that the internal electrode 19 includes the individual portions 19*a* confronting the respective ones of the openings of the pressure chambers 16 and the connection portions 19*b* connecting the individual portions 19*a* with one another. For example, like the surface electrodes 18, it may be so configured that individual portions confronting the respective ones of the openings of the pressure chambers 16 are separated from one another, without being connected by connection portions.

In the above-described embodiment, the thickness of the piezoelectric layer 17*a* is greater than the sum of the thickness of the piezoelectric layer 17*b* and the thickness of the vibration plate 17*c*. Because the thickness of the piezoelectric layer 17*a* for recording ejection operations is designed to be relatively large in this way, the deformation efficiency of the actuator unit for recording ejection operations can be improved. However, the thickness of each piezoelectric layer included in the actuator is not limited to this relationship, and may be modified appropriately. For example, the sum of the thickness of the piezoelectric layer 17*a* and the thickness of the piezoelectric layer 17*b* may be the same as the thickness of the vibration plate 17*c*, or may be greater than the thickness of the vibration plate 17*c*.

In the above-described embodiment, the piezoelectric layer 17*a* which is the outermost layer is for recording ejection operation, whereas the piezoelectric layer 17*b* arranged at a position closer to the upper surface 12*x* of the channel unit 12 than the piezoelectric layer 17*a* is for non-ejection flushing. However, the arrangement is not limited to this. For example, it may be so configured that the piezoelectric layer 17*a* is for non-ejection flushing, and that the piezoelectric layer 17*b* is for recording ejection operation.

In the actuator unit 17, another piezoelectric layer may be stacked on the piezoelectric layer 17*a* as the upper layer, or one or a plurality of piezoelectric layers may be sandwiched between the piezoelectric layers 17*a* and 17*b*. Further, the vibration plate 17*c* may be omitted.

The deformation mode of the actuator is not to limited to the unimorph type, and may be other deformation modes such as a monomorph type, bimorph type, multimorph type, and a modified type of the monomorph type etc.

The piezoelectric layers 17*a* and 17*b* may be polarized in the opposite direction from each other along the stacking direction.

In the above-described embodiment, descriptions are provided on the actuator unit 17 including a large number of active portions corresponding to the respective ones of a large number of the pressure chambers 16. However, the actuator of the invention is not limited to this configuration. The actuator may be provided individually to each pressure chamber 16 of the head 10, where a piezoelectric layer is arranged to confront only one pressure chamber 16 without straddling a plurality of pressure chambers 16.

As to voltage pulses corresponding to the ejection driving signal, the non-ejection driving signal, and the preliminary-ejection driving signal, waveforms, pulse widths, timings of rising and falling, voltage values of low and high levels, etc. characterizing the voltage pulses can be modified appropriately depending on ambient temperature, viscosity of ink, and other various conditions.

For example, the surface electrodes 18 and the internal electrode 19 may be kept at a float potential at normal times (at the times except when recording, non-ejection flushing, preliminary ejection, and the like are performed).

At the time of non-ejection flushing, an electric field may be generated in the piezoelectric layer for recording ejection operation. Further, at the time of recording ejection operation, a voltage may be applied to the piezoelectric layer for non-ejection flushing and an electric field may be generated.

Note that, in order to prevent an electric field from being generated in the piezoelectric layer for recording ejection operation at the time of non-ejection flushing even when the arrangement of piezoelectric layers and electrodes is modified in various ways, controls are performed so that an electrode formed on a surface of the piezoelectric layer for recording ejection operation on the opposite side from the channel member and an electrode arranged at a position closest to a surface of the piezoelectric layer for recording ejection operation on the opposite side from the channel member are at the same potential.

The timing of non-ejection flushing, that is, the timing of supplying the non-ejection driving signal is not limited to a specific timing, and may be arbitrary timing in the latter part of one recording cycle T0. Further, non-ejection flushing may be performed once in two or more recording cycles T0, not in each recording cycle T0. Or, non-ejection flushing may be performed only between sheets of paper P, not during recording on one sheet of paper P, or may be performed only during recording on one sheet of paper P, not between sheets of paper P, or may be performed at other timings.

It is not necessary to perform controls so that an electric field generated in the piezoelectric layer for recording ejection operation becomes relatively small when the preliminary-ejection driving signal is supplied. It is also possible to obtain large displacement by applying preliminary-ejection driving voltage pulses to not only the piezoelectric layer 17*b* for non-ejection flushing but also the piezoelectric layer 17*a* for recording ejection operation, so that the both piezoelectric layers are driven simultaneously. Further, preliminary ejection need not be performed. That is, the controller 1*p* may be configured to generate only the ejection driving signal and non-ejection driving signal, and not to generate the preliminary-ejection driving signal and not to perform controls by the preliminary-ejection driving signal.

The definition of relative movement in the recording cycle T0 includes not only the case in which paper P moves relative to the head 10 located at a fixed position, but also the case in which the head 10 moves relative to paper P located at a fixed position.

In the above-described embodiment, the piezoelectric layer 17*a* for recording ejection operation is arranged at the upper side, and the piezoelectric layer 17*b* for meniscus vibration (for non-ejection flushing) is arranged at the lower side. Further, the main electrode region 18*a* of the surface electrode 18 has a similarity shape to the opening of the pressure chamber 16 and has a smaller size than the opening, whereas the individual portion of the internal electrode 19 has a similarity shape to the opening of the pressure chamber 16 and has a larger size than the opening. However, the sizes of the main electrode region 18*a* and the individual portion are not limited to those as described above. For example, the main electrode region 18*a* may have a similarity shape to the opening of the pressure chamber 16 and have a larger size than the opening, whereas the individual portion may have a similarity shape to the opening of the pressure chamber 16 and have a smaller size than the opening.

In the ejection driving voltage and non-ejection driving voltage, pulse widths of voltage pulses need not be set to the same value as discharging periods. The pulse widths may be shorter or longer than the discharging periods. In either case, the non-ejection driving signal has a higher frequency than the ejection driving signal.

For image formation, the above-described embodiment adopts so-called "pull and eject method" where the piezoelectric layer 17*a* is displaced with the vibration mode $d_{31}$, and an operation of supplying ink is performed prior to an operation of ejecting an ink droplet corresponding to one ejection driving voltage pulse. However, it is not limited to this method. For example, so-called "push and eject method" may be adopted where the piezoelectric layer 17*a* is displaced with the vibration mode $d_{33}$. In this case, it is not necessary to provide a discharging period immediately prior to application of the ejection driving voltage pulse. An ink droplet is ejected from the ejection port 14*a* at the timing of rising of the voltage pulse, and ink is supplied into the pressure chamber 16 at the timing of falling of the voltage pulse.

In the above-described embodiment, although the phrase "during recording onto one sheet of paper" is defined as "a period in which one sheet of paper P being conveyed is in confrontation with the ejection ports 14*a* of each head 10", it may be defined as "a period in which the recording region of one sheet of paper P (a part of the entire region of paper P) being conveyed is in confrontation with the ejection ports 14*a* of each head 10". Further, in the above-described embodiment, the phrase "between sheets of paper" is defined as "a period in which no sheet of paper P is in confrontation with the ejection ports 14*a* of the head 10 after recording onto a previous sheet of paper P is finished and before recording onto a subsequent sheet of paper P is performed, the previous sheet and the subsequent sheet of paper P being two sheets of paper P arranged in the conveying direction". However, it may be defined as "a period in which the ejection ports 14*a* of the head 10 are in confrontation with a region between the trailing edge of a recording region of a previous sheet of paper P (the upstream end of the recording region in the conveying direction, or the downstream end of the in-between region on the conveying belt 8) and the leading edge of a recording region of a subsequent sheet of paper P (the downstream end of the recording region in the conveying direction, or the upstream end of the in-between region on the conveying belt 8), the previous sheet and the subsequent sheet of paper P being two sheets of paper P arranged in the conveying direction".

In the above-described embodiment, at the time of preliminary ejection, ink droplets are ejected by substantially driving the piezoelectric layer 17*b*. However, depending on a load on the piezoelectric layer 17*a* at the time of preliminary ejection, ink droplets may be ejected by driving the piezoelectric layer 17*a*. In this case, voltage pulses can be applied to the piezoelectric layer 17*a* by keeping the internal electrode 19 at ground potential and generating pulse-shaped potential changes in the surface electrode 18.

In the above-described embodiment, in S4, the amount of discharged ink can be suppressed by performing both discharging of ink (the former part of the recording cycle T0) and vibration of menisci (the latter part of the recording cycle T0). However, the operation is not limited to this, and only discharging of ink may be performed. In this case, for example, electric potentials can be controlled so that the internal electrode 19 is kept at ground potential, whereas, in the surface electrode 18, pulse-shaped potential changes are generated in the former part of the recording cycle T0, like the first recording cycle T0 shown in FIG. 7A, and the potential does not fall at the ending time point of the former part but leads to the next recording cycle T0 while keeping a high level. In this case, too, menisci are reproduced by discharging ink with increased viscosity, and recovery of ejection performance can be performed.

In S8 of the above-described embodiment, although the surface electrode 18 is controlled to be the same potential as the internal electrode 19, the surface electrode 18 may be in an electrically float condition. In this case, although a voltage can be induced in the piezoelectric layer 17*a*, an influence of the inductive voltage on piezoelectric performance of the piezoelectric layer 17*a* is small enough to be neglected.

In S10, as long as a predetermined voltage is applied to the piezoelectric layer 17*a* in the former part of one recording cycle T0, the internal electrode 19 need not be kept at ground potential. For example, the internal electrode 19 may be at an electric potential of several volts (V) relative to the common electrode 20.

In S10, the first voltage pulse of the non-ejection driving voltage may appear in a certain period after the last voltage pulse of the ejection driving voltage in the former part of the recording cycle T0 is applied. In this case, the number of meniscus vibration becomes larger at the ejection port 14*a* at which the number of ejected ink droplets in the recording cycle T0 is smaller, because the first voltage pulse of the non-ejection driving voltage appears earlier. Thus, nonuniformity of ejection performance among the ejection ports 14*a* can be reduced. Note that, in this case, too, it is preferable that vibration of a meniscus (application of the non-ejection driving voltage) be stopped with a sufficient period to attenuate residual vibration before the next recording cycle T0 starts.

The invention can be applied to both of the line type and the serial type. Further, it is not limited to a printer, but can be applied to a facsimile apparatus, a copier, and the like. Further, it can also be applied to an apparatus that ejects droplets other than ink droplets.

What is claimed is:

1. A liquid ejecting device comprising:

a channel member formed with liquid channels having ejection ports for ejecting droplets, the channel member having a surface formed with a plurality of openings through which a part of each liquid channel is exposed;

an actuator including a layered body disposed on the surface of the channel member so as to confront the plurality of openings for applying energy to liquid in the plurality of openings, the layered body including a first piezoelectric layer and a second piezoelectric layer stacked from a side closer to the plurality of openings in this order, each of the first and second piezoelectric layers being sandwiched between electrodes with respect to a stacking direction;

a driving-signal generating section configured to generate driving signals for driving the actuator, the driving-signal generating section being configured to generate an ejection driving signal for ejecting droplets from the ejection ports and a non-ejection driving signal for vibrating a meniscus formed in the ejection ports without ejecting droplets from the ejection ports; and a voltage applying section configured, based on image data of an image to be recorded on a recording medium, to apply a voltage corresponding to the ejection driving signal to electrodes sandwiching one of the first and second piezoelectric layers during a first period, and to apply a voltage corresponding to the non-ejection driving signal to only electrodes sandwiching an other one of the first and second piezoelectric layers during a second period different from the first period.

2. The liquid ejecting device according to claim 1, wherein the second piezoelectric layer is an outermost layer which is the farthest away from the surface of the channel member among the piezoelectric layers included in the layered body; and wherein a surface electrode is formed on a surface of the second piezoelectric layer on a side opposite the channel member, the surface electrode having a similarity shape to the opening and a size smaller than the opening as viewed from the stacking direction.

3. The liquid ejecting device according to claim 2, wherein the one of the first and second piezoelectric layers is the second piezoelectric layer, and the other one of the first and second piezoelectric layers is the first piezoelectric layer.

4. The liquid ejecting device according to claim 1, wherein another electrode is formed on a surface of the other one of the first and second piezoelectric layers on a side opposite the channel member, the another electrode having a size larger than the opening as viewed from the stacking direction.

5. The liquid ejecting device according to claim 1, wherein another electrode is formed on a surface of the other one of the first and second piezoelectric layers on a side opposite the channel member; and wherein the another electrode comprises a plurality of individual portions in confrontation with respective ones of the openings and a plurality of connection portions that connect the plurality of individual portions with one another.

6. The liquid ejecting device according to claim 1, wherein the actuator comprises a vibration plate disposed between the layered body and the channel member to seal the opening.

7. The liquid ejecting device according to claim 1, wherein an electrode in the layered body that is closest to the surface of the channel member is a ground electrode that is connected to ground.

8. The liquid ejecting device according to claim 7, wherein the ground electrode extends over an entirety of a surface on which the ground electrode is formed.

9. The liquid ejecting device according to claim 7, wherein the first and second piezoelectric layers are polarized in the same direction along the stacking direction.

10. The liquid ejecting device according to claim 9, wherein the first and second piezoelectric layers are disposed adjacent to each other with only an electrode, and without another piezoelectric layer, interposed therebetween with respect to the stacking direction; and wherein the voltage applying section is configured to perform controls, during a period in which the ejection driving signal is not supplied, so that both of an electrode formed on a surface of the first piezoelectric layer on a side opposite the channel member and an electrode formed on a surface of the second piezoelectric layer on a side opposite the channel member have the same electric potential relative to the ground electrode.

11. The liquid ejecting device according to claim 1, wherein the voltage applying section is configured to perform controls, during a period in which the ejection driving signal is not supplied, so that both of an electrode formed on a surface of the one of the first and second piezoelectric layers on a side opposite the channel member and an electrode formed on a surface of the one of the first and second piezoelectric layers on a side closer to the channel member have the same electric potential.

12. The liquid ejecting device according to claim 1, wherein the voltage applying section is configured to apply, within a single recording cycle, pulse-shaped voltages corresponding to the non-ejection driving signal to the electrodes sandwiching the other one of the first and second piezoelectric layers, after a last pulse-shaped voltage corresponding to the ejection driving signal is applied to the electrodes sandwiching the one of the first and second piezoelectric layers, where the single recording cycle is a time period required for the recording medium to move relative to the channel member by a unit distance corresponding to a resolution of the image to be recorded on the recording medium.

13. The liquid ejecting device according to claim 12, wherein the driving-signal generating section is configured to generate, within the single recording cycle, a plurality of kinds of ejection driving signals for ejecting different amounts of droplets from the ejection ports; and wherein the voltage applying section is configured to apply pulse-shaped voltages corresponding to the non-ejection driving signal to the electrodes sandwiching the other one of the first and second piezoelectric layers after an elapse of a required time period from a starting time point of the single recording cycle, the required time period being a time period required for applying pulse-shaped voltages corresponding to the ejection driving signal for ejecting a maximum amount of droplets among the plurality of kinds of ejection driving signals.

14. The liquid ejecting device according to claim 1, wherein, when a plurality of recording mediums moves sequentially relative to the channel member so that continuous recording is performed, the voltage applying section is configured to apply a voltage corresponding to the non-ejection driving signal to the electrodes sandwiching the other one of the first and second piezoelectric layers during a period in which the ejection ports does not confront a recording region of the recording medium, which is a period after recording for one recording medium is finished and before recording for the next recording medium is performed.

15. The liquid ejecting device according to claim 1, wherein the voltage applying section is configured to apply a constant voltage to the electrodes sandwiching the other one of the first and second piezoelectric layers during a period in which pulse-shaped voltages corresponding to the ejection driving signal are applied to the one of the first and second piezoelectric layers.

16. The liquid ejecting device according to claim 1, wherein the driving-signal generating section is configured to further generate a preliminary-ejection driving signal for ejecting droplets from the ejection ports during the second period; and wherein the voltage applying section is configured to apply a voltage corresponding to the preliminary-ejection driving signal to the electrodes sandwiching the other one of the first and second piezoelectric layers so that a maximum electric field generated in the one of the first and second piezoelectric layers is less than a maximum electric field generated in the other one of the first and second piezoelectric layers.

17. The liquid ejecting device according to claim 1, wherein the non-ejection driving signal has a higher frequency than the ejection driving signal.

* * * * *